US009387710B2

(12) United States Patent
Shinjo et al.

(10) Patent No.: US 9,387,710 B2
(45) Date of Patent: Jul. 12, 2016

(54) INKJET PRINTER WITH FAN AND PORT SELECTIVELY BLOWING OUTSIDE OR RECIRCULATED AIR

(71) Applicant: CANON KABUSHIKI KAISHA, Tokyo (JP)

(72) Inventors: Ryoya Shinjo, Kawasaki (JP); Hiromasa Yoneyama, Chigasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/698,240

(22) Filed: Apr. 28, 2015

(65) Prior Publication Data

US 2015/0314616 A1 Nov. 5, 2015

(30) Foreign Application Priority Data

May 1, 2014 (JP) ..... 2014-094750

(51) Int. Cl.

| | |
|---|---|
| ***B41J 29/377*** | (2006.01) |
| ***B41J 29/38*** | (2006.01) |
| ***B41J 11/00*** | (2006.01) |
| ***B41J 2/01*** | (2006.01) |

(52) U.S. Cl.

CPC .. *B41J 29/38* (2013.01); *B41J 2/01* (2013.01); *B41J 11/002* (2013.01); *B41J 11/0015* (2013.01); *B41J 11/0085* (2013.01); *B41J 29/377* (2013.01)

(58) Field of Classification Search

None

See application file for complete search history.

(56) References Cited

U.S. PATENT DOCUMENTS

| | | | | |
|---|---|---|---|---|
| 2005/0122372 | A1* | 6/2005 | Shimizu | B41J 11/007 347/22 |
| 2011/0037819 | A1* | 2/2011 | Mizutani | B41J 11/002 347/108 |
| 2013/0002749 | A1* | 1/2013 | Masuda | B41J 11/06 347/16 |

FOREIGN PATENT DOCUMENTS

| | | | |
|---|---|---|---|
| JP | 2006068966 | A * | 3/2006 |
| JP | 2007-152902 | A | 6/2007 |
| JP | 2007152902 | A * | 6/2007 |

* cited by examiner

*Primary Examiner* — Geoffrey Mruk
*Assistant Examiner* — Bradley Thies
(74) *Attorney, Agent, or Firm* — Fitzpatrick, Cella, Harper & Scinto

(57) ABSTRACT

Provided is a printer with a blower that is capable of easier maintenance than a conventional printer. In order for this, the printer comprising an access cover and a blower unit, when the access cover is in a closed state, the blower unit blows airflow on a sheet where ink has been applied, when the access cover is in an opened state, the part of the blower unit is/are open together with the access cover to be exposed.

10 Claims, 26 Drawing Sheets

| FIG.19A |
| --- |
| FIG.19B |

INKJET PRINTER WITH FAN AND PORT SELECTIVELY BLOWING OUTSIDE OR RECIRCULATED AIR

BACKGROUND OF THE INVENTION

1. Field of the Invention

The present invention relates to an inkjet type printer that has a blower for promoting drying of ink that has been applied to a sheet.

2. Description of the Related Art

In an inkjet type printer, in order to shorten the drying time for the ink that is applied to a sheet, preferably means for promoting the drying of the ink are provided. The printer that is disclosed in Japanese Patent Laid-Open No. 2007-152902 is constructed so that air that is discharged from a fan that is provided in a suction platen returns upward through a blower duct and flows over the platen to efficiently recover ink mist. This does not mean that the drying of a sheet is promoted, however, airflow is formed over the sheet, and as a result, is considered to also function to promote the drying of ink.

The construction disclosed in Japanese Patent Laid-Open No. 2007-152902 is such that a blower fan that forms airflow inside the printer is below the inkjet head and furthermore is embedded below the platen. Ink mist floats on the air that is sucked in by the suction platen, so it becomes easy for the ink mist to adhere to the fan directly below causing the fan to become dirty. Therefore, it is necessary to perform maintenance frequently, however, in the case of the printer disclosed in Japanese Patent Laid-Open No. 2007-152902 maintenance is structurally difficult to perform.

SUMMARY OF THE INVENTION

Based on the knowledge described above, the present invention provides a printer having a blower for which maintenance can be performed more easily than was done conventionally.

The printer of the present invention is an inkjet printing apparatus comprising: an access cover capable of being opened to allow maintenance of the apparatus; and a blower unit, at least part thereof being supported by the access cover, wherein when the access cover is in a closed state, the blower unit blows airflow on a sheet where ink has been applied; and when the access cover is in an opened state, the part of the blower unit is/are open together with the access cover to be exposed.

With the present invention, when the access cover is opened, the printing head and blower are exposed and it is easy to perform maintenance.

Further features of the present invention will become apparent from the following description of exemplary embodiments (with reference to the attached drawings).

BRIEF DESCRIPTION OF THE DRAWINGS

FIG. 21 is a diagram showing the relationship of FIGS. 21A and 21B;

DESCRIPTION OF THE EMBODIMENTS (First Embodiment)

Figure 1:
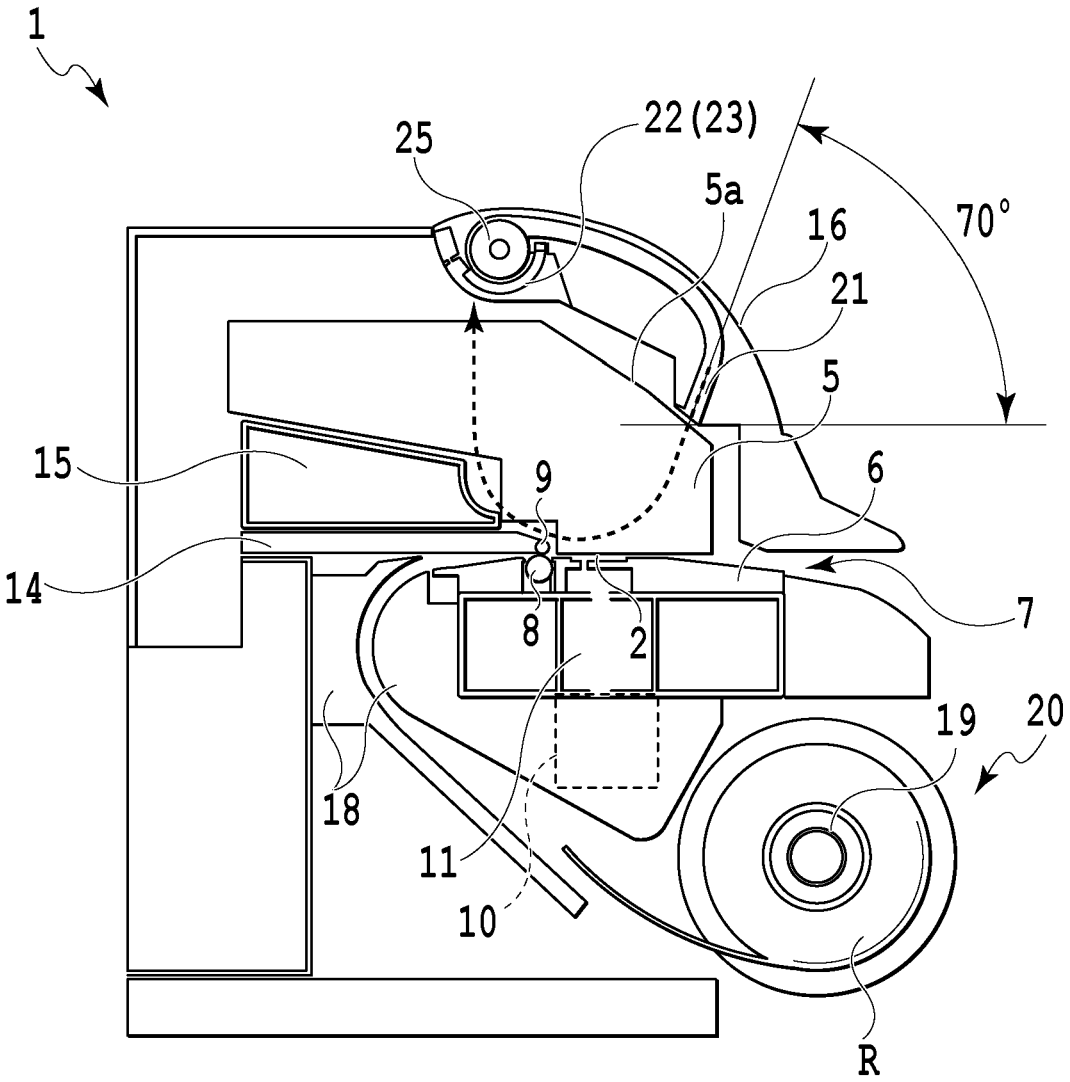
FIG. 1 is a cross-sectional view of an inkjet printer.

In the following, a first embodiment of the present invention will be explained with reference to the drawings. FIG. 1 is a cross-sectional view of an inkjet type printer. In the printer 1 a roll-type sheet R having a maximum width of 1117.6 mm is used as the sheet. The paper feeder 20 of the printer 1 comprises a spool shaft 19 that is supported on both ends so as to rotate freely, and the roll-type sheet R is installed on that spool shaft 19. One end of the roll-type sheet R that is pulled from the paper feeder 20 through a pair of U-turn shaped conveyance guides 18, is nipped by a conveyance roller 8 and pinch roller 9, and is sequentially let out to a printing area 2 by being driven and fed by the conveyance roller 8.

When this happens, a rotation brake force constantly acts on the spool shaft 19 of the paper feeder 20 by way of a torque limiter (not illustrated in the figure), so a specified amount of tension is always applied to the sheet R that is let out, making sure that the sheet R does not become slack along the conveyance path. Then the sheet R undergoes an image formation process in the printing area 2.

Figure 2:
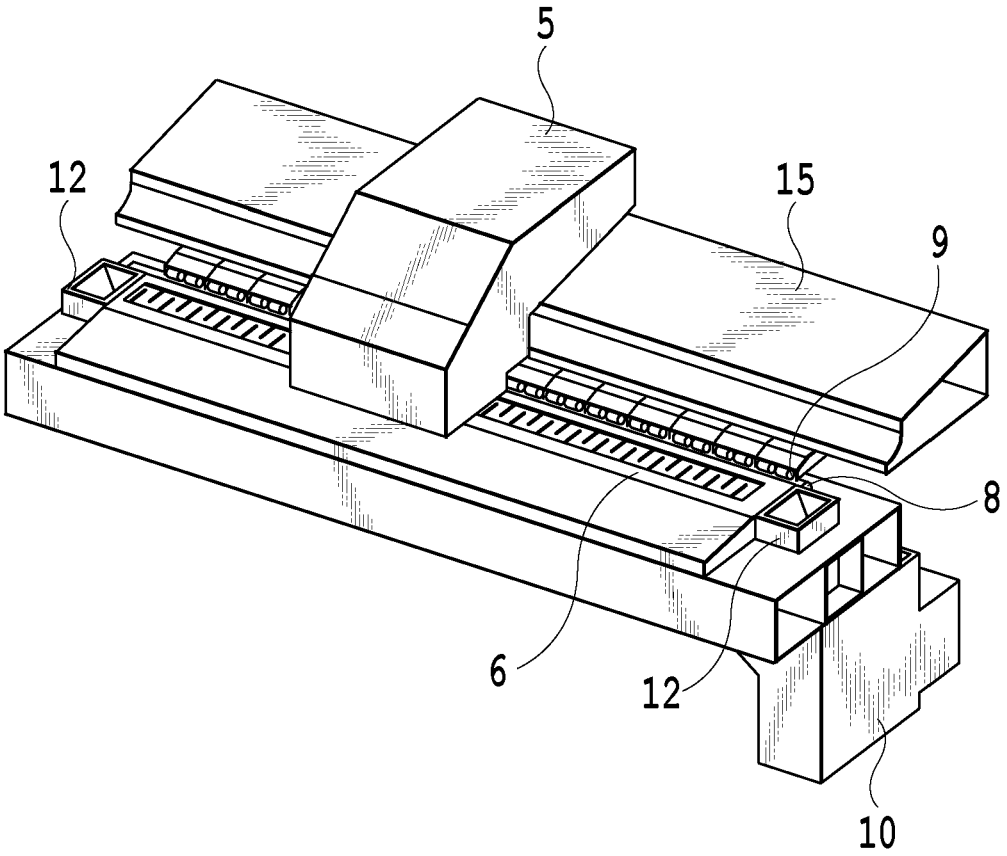
FIG. 2 is a perspective view that illustrates the inside of a printer.
Figure 3:
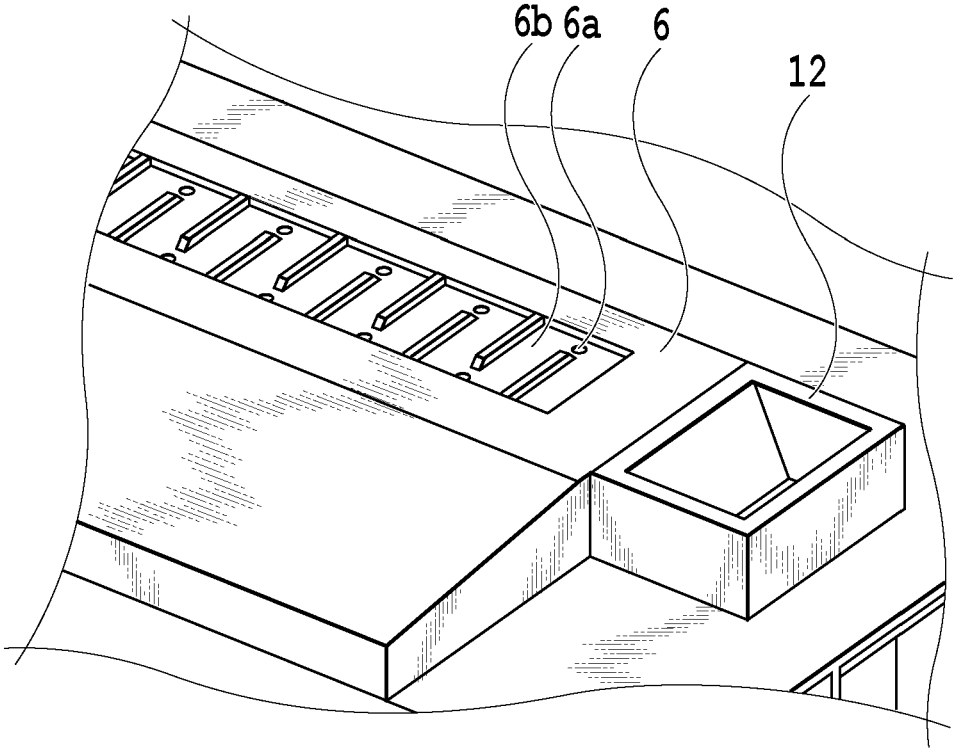
FIG. 3 is a perspective view of a platen that supports a sheet during printing.
Figure 4:
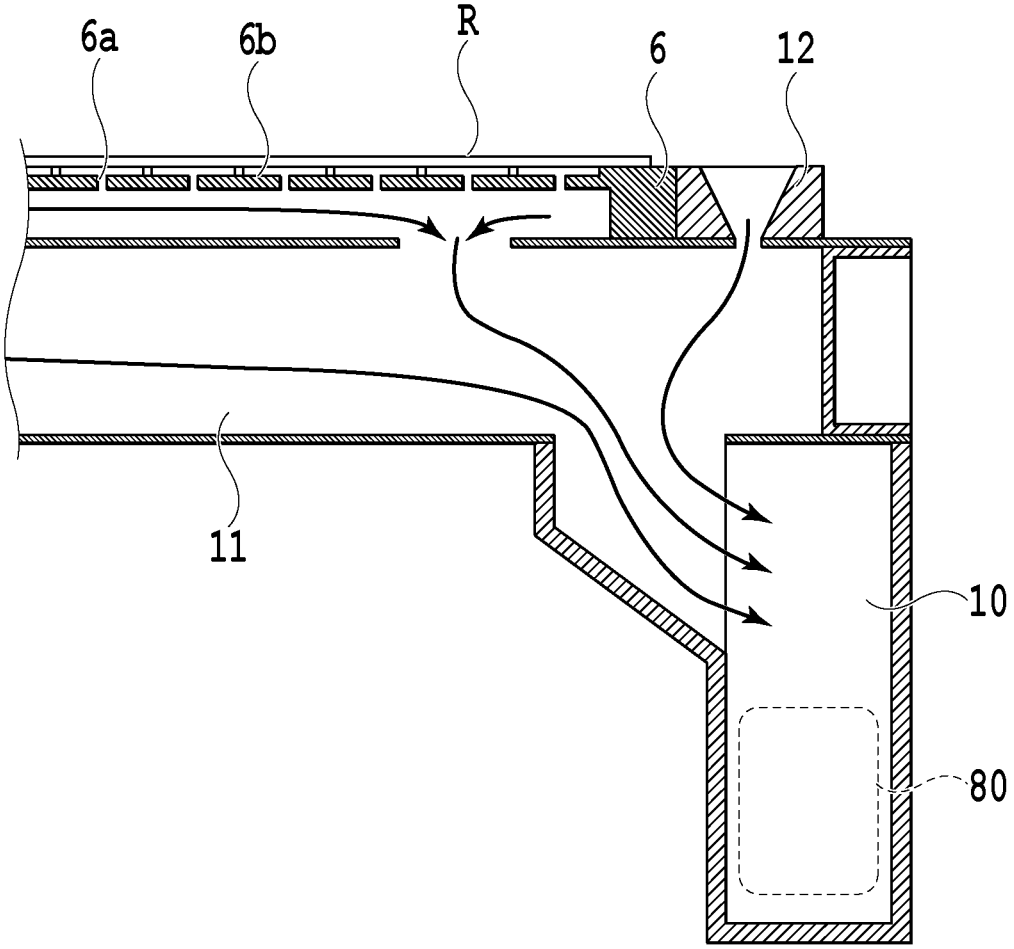
FIG. 4 is a cross-sectional view of a platen.

FIG. 2 is a perspective view illustrating the inside of the printer 1. FIG. 3 is a perspective view of a platen that provides suction support of a sheet R during printing, and FIG. 4 is a cross-sectional view of the platen. Next, the image formation process will be explained. In the printing area 2, a printing head that comprises ejection ports (not illustrated in the figure) for ejecting ink is mounted in a carriage 5 that is able to move back-and-forth in the width direction (main scanning direction) of the sheet R, and performs image formation on the sheet R that is supported by suction on the rear surface by the platen 6 (suction platen). More specifically, when conveyance of the sheet R is stopped, the carriage 5 performs a forward or backward operation, and during that operation, the printing head performs one line of printing by ejecting ink drops onto the sheet R.

After one line of printing has finished, the sheet R is conveyed a specified amount in a direction that is orthogonal to the main scanning direction of the carriage 5 by the conveyance roller 8 and pinch roller 9 that comes in pressure contact with the conveyance roller 8, and then the carriage 5 performs a forward or backward operation again, and the next one line is printed. In this way, the printer repeatedly performs intermittent conveyance of the sheet R, and an image is formed as each line of printing is performed. During image formation, by suction ports 6*a* and suction grooves 6*b* that are provided in an area of the platen 6 that faces the ejection ports causing a suction force to act on the sheet R, the sheet R is maintained on an approximately horizontal surface by the platen 6 (see FIG. 4). By causing a platen fan (suction fan) 10 to turn, a suction force acts on the sheet R, and the platen fan 10 applies negative pressure to the sheet R by a buffer chamber 11 that is provided below the platen 6.

Moreover, a preliminary ejection port 12 is provided on the outside in the width direction of the platen 6, and when the printing head passes over the preliminary ejection port 12, so-called preliminary ejection, in which ink that does not contribute to printing is ejected from the ejection ports onto the preliminary ejection port 12, is performed. Ejection onto the preliminary ejection port 12 allows ink inside the ejection ports to be periodically ejected, which prevents ink inside the ejection ports from becoming thick due to drying. The buffer chamber 11 is also connected to the preliminary ejection port 12, and ink drops that are ejected onto the preliminary ejection port 12 become an ink mist that flows through the buffer chamber 11 toward the platen fan 10 (see FIG. 4). When this happens, construction is such that air that was sucked into the printer is discharged to the outside from the printer, however a filter 80 is provided in the discharge port of the platen fan 10, and this filter 80 collects the ink mist that flowed from the preliminary ejection port 12 so that ink is not leaked to the outside of the printer.

When the image formation process is performed on a sheet for typical inkjet printing, as the ink drops that are ejected from the printing head hit the surface of the sheet, a coating layer on the sheet surface quickly absorbs the moisture of the ink drops. Therefore, when the carriage 5 reverses and prints the next line, the moisture of ink drops that hit the surface of the sheet before is sufficiently reduced, so it is possible to suppress any effect on the ink drops that will later hit the adjacent positions.

On the other hand, in the case of a sheet that is used in offset printing or the like, moisture absorbency of the coating layer on the sheet surface is low, so the speed that the moisture of the ink drops that hit the surface of the sheet is absorbed becomes slow. Therefore, when the carriage 5 reverses and prints the next line, the moisture of the ink drops on the surface of sheet that hit before is not sufficiently reduced. In that state, when ink drops hit positions adjacent to positions where ink drops hit before, a phenomenon called beading occurs in which ink drops pull against each other due to the action of surface tension of each of the ink drops. When beading occurs, the ink drops on the surface of the sheet become fixed in a large state, and the graininess of the outputted printed material stands out, causing the image quality to deteriorate.

Here, how the problem described above is solved will be explained. In FIG. 1, the printer 1 comprises a blower fan 25 that blows air toward the printing area 2 of the sheet R. The blower fan 25 is provided further above than the carriage 5, and the air that is sucked in by the blower fan 25 is discharged from a blower port 21 by way of a blower duct 24. The air that is discharged from the blower port 21 is blown toward the printing area (area where ink will be applied) 2 of the sheet R.

By blowing air toward the printing area 2 of the sheet R, a highly moist layer of saturated liquid vapor existing around the sheet surface is blown in the downstream direction of the blowing direction, which promotes the drying of ink drops on the sheet surface. In other words, the speed of reducing the moisture content of the ink drops on the sheet surfaces increases, so it is possible to suppress the occurrence of the beading phenomenon. The velocity of the air that is blown toward the sheet R is set to 4.0 m/s. This blown air is performed from above the carriage 5 in the downstream to upstream direction of the sheet conveyance direction (see the dashed arrow in FIG. 1).

The reason for blowing air from above the carriage 5 is so that the inflow current of air to below the printing head due to the blowing air is reduced as much as possible, and so that the impact precision of ink drops is not disturbed. The angle of the blowing air with respect to horizontal is taken to be approximately 70°, and when the direction of blown air from the blower port 21 is viewed as a projected profile of the side surface, the blown air from the blower port 21 is in a positional relationship with the inclined surface 5*a* of the carriage 5. In other words, due to the inclined surface 5*a* of the carriage, the blown air is not blown directly to below the printing head. The angle of the blown air can be suitably changed according to the construction of the printer.

In order to prevent ink mist from leaking from the paper discharge port 7 when the distance from the blower port 21 to the paper discharge port 7 that is downstream in the sheet conveyance direction of the printing area 2 is comparatively short, air should be blown from downstream to upstream in the sheet conveyance direction, which is on the paper discharge port side. Air that is blown onto the sheet surface flows over the sheet surface and carries vapor and ink mist that is on the sheet surface in the printing area to upstream in the conveyance direction. The airflow that includes vapor and ink mist flows over a pinch roller holder 14 that is provided on the upstream side of the printing area, and then hits a structural member 15, which turns the direction of the airflow to upstream in the vertical direction. In order to make it easy to change the vector direction of the airflow upward in the vertical direction, preferably the surface of the structural member 15 that the airflow hits has a tapered or curved shape.

The airflow that hits the structural member 15 and changes direction upward in the vertical direction circulates inside the printer by entering into the blower fan 25 again and being fed through the blower duct 24 toward the blower port 21. With this kind of airflow, air is circulated in a path that includes the printing area. The blower fan 25 is provided as part of a blower for internally circulating air inside the inkjet printer in the area near the printing area of the printer.

In this way, the blower unit generates an airflow that circulates inside the printer. The blower unit comprises a blower fan 25, a blower duct 24, a blower port 21, an air intake port 22 and a filter 23. At least part of the components of the blower unit is supported by the access cover 16. When the access cover 16 is opened, the supported components of the blower unit also rotate much and become exposed to the user.

Performing internal circulation presumes that ejection (printing) is being performed that generates an ink mist. There is nothing that blocks the circulation of airflow in portions in the printing area other than the carriage 5, so it is possible to obtain a good circulation cycle. Therefore, even with a small blower fan 25 and small amount of circulating airflow, it is possible to obtain an airflow that promotes sufficient drying of ink drops on the sheet surface, and that does not disturb the impact precision of ink drops.

Moreover, air inside the printer is internally circulated by the blower fan 25, and is discharged to outside the printer by the platen fan 10. The platen fan 10 carries out the role of generating suction force that sucks and supports the sheet R, and discharging air that is inside the printer to the outside of the printer to generate a small negative pressure inside the printer. By air being circulated inside the printer by the blower fan 25, and discharged by the platen fan 10, regardless of the difference in the amount of airflow by each fan, the total air pressure inside the printer is maintained at a negative pressure. By creating negative pressure inside the printer, generated ink mist and the volatile component of ink are prevented from leaking to the outside of the printer.

Figure 5:
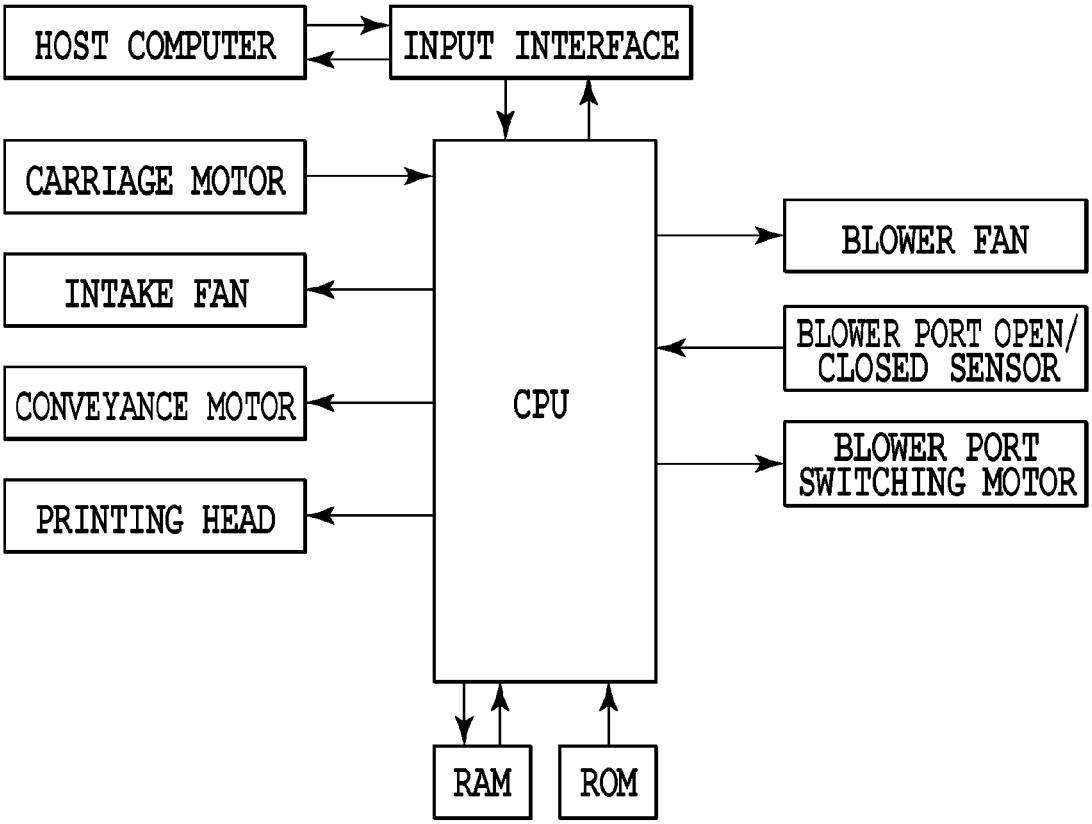
FIG. 5 is a block diagram illustrating the construction of a printer.

FIG. 5 is a block diagram illustrating the system configuration of a printer. The CPU performs overall control of printing and blowing air according to a control program that is stored in ROM. Printing data, printing mode setting information and the like are inputted to the CPU from a host computer by way of an input interface. Moreover, the CPU is constructed so as to write printing data and the like to RAM, or read printing data from RAM. The CPU performs control based on the printing data and printing mode information from the host computer. When printing data, printing mode setting information and the like are transferred to the printer from the host computer, the CPU determines the printing control according to the printing mode setting information and starts printing.

Figure 6:
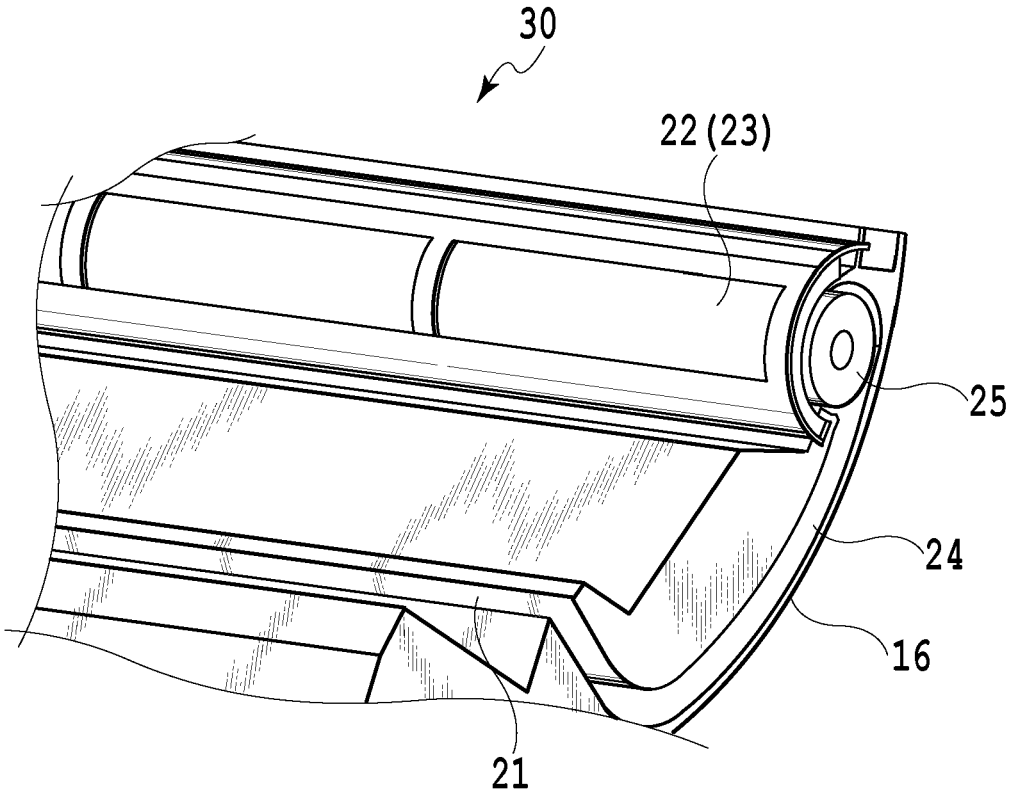
FIG. 6 is a perspective cross-sectional view of a blower fan in a printer.
Figure 7:
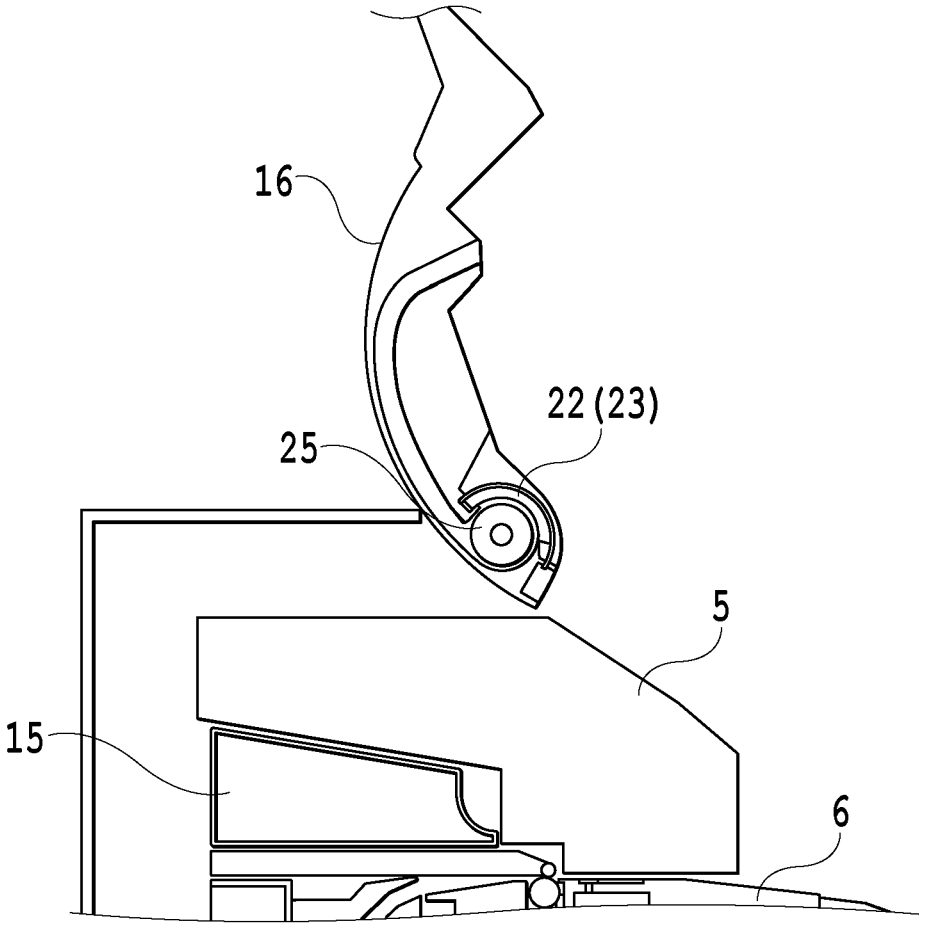
FIG. 7 is a cross-sectional view of a printer when the access cover is open.

FIG. 6 is a perspective cross-sectional view of a blower fan in the printer 1, and FIG. 7 is a cross-sectional view when the access cover of the printer 1 is open.

The blower fan 25 is positioned above the carriage 5 (structural member 15), and that position is located at the center of rotation of the access cover 16 that is constructed so as to be able to rotate. The access cover 16 is provided so as to be able to open and close with respect to the frame of the printer body in order for maintenance of the inside of the printer. The user opens the access cover 16 in order to perform maintenance such as exchanging the printing head or removing a sheet that is stuck near the platen due to a paper feed jam. The blower duct 24 and installation part of the filter 23 on the blower port side are integrally constructed with the access cover 16.

Therefore, construction takes into consideration of the ability of the user to replace the filter 23, so that when the access cover 16 is open, the replaceable filter 23 is in a positional relationship facing the front of the printer (in other words, in front of the user). Moreover, when the access cover 16 is open, the blower fan 25 is exposed and it becomes possible to easily access the blower fan 25 and to perform maintenance of the blower fan 25. Furthermore, with the access cover 16 open, the blower duct 24 also is exposed, so it is also possible to easily perform maintenance of the blower duct 24.

A cross-flow fan is used as the blower fan 25. A cross-flow fan is wide in the width direction, and is capable of blowing approximately uniform air, so is suitable for evenly blowing air onto a sheet R that is long in the width direction in order to dry ink. Moreover, a cross-flow fan that has the characteristic of the suction direction being nearly orthogonal to the blowing direction is suitable for efficiently performing internal circulation. The filter 23 is provided in the air intake port 22 that is connected to the inside of the printer and collects vapor and ink mist that was not completely collected by the platen fan 10 and that circulates inside the printer.

Figure 8:
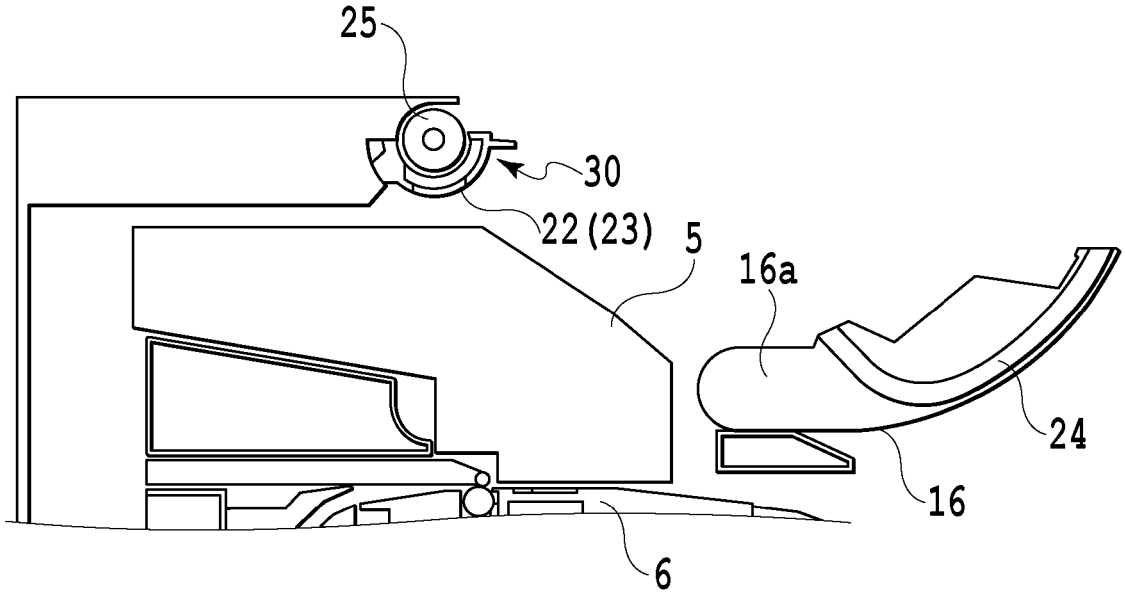
FIG. 8 is a cross-sectional view of a variation of a printer when the access cover is open.

FIG. 8 is a cross-sectional view illustrating a different state of an access cover that can be opened and closed. In this example, the center of rotation of the access cover 16 is provided on the lower side in the vertical direction, and is opened on the side in front of the user. A cross-flow fan and a replaceable filter 23 are provided in the frame of the printer body, and a blower duct 24 is provided in the access cover 16. When the user opens the access cover 16, the blower duct 24 and blower port, which are part of the components of the blower unit, open together with the access cover. With the access cover 16 open, the blower fan 25, blower duct 24 and filter 23 can be accessed easily, and maintenance can be performed.

Figure 9A:
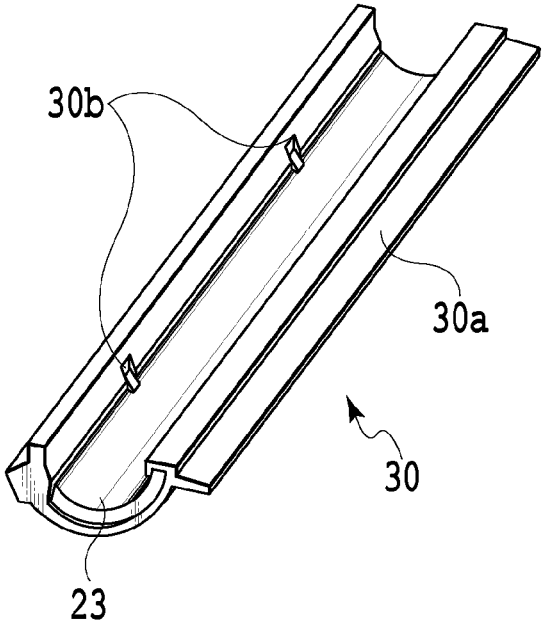
FIG. 9A is a perspective view that illustrates a filter attachment.
Figure 9B:
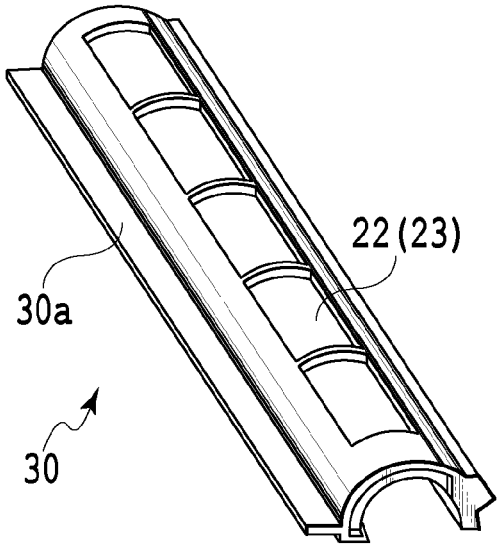
FIG. 9B is a perspective view that illustrates a filter attachment.

A filter attachment 30 can be freely installed into or removed from the printer body in order to be able to replace the filter 23, and when replacing the filter, the entire filter attachment 30 is replaced. FIG. 9A and FIG. 9B are perspective views illustrating the schematic construction of the filter attachment 30. A finger grip 30*a* for the user when installing or removing the attachment, tabs 30*b* that hold the filter 23, and air intake port 22 are provided in the filter attachment 30.

Figure 10:
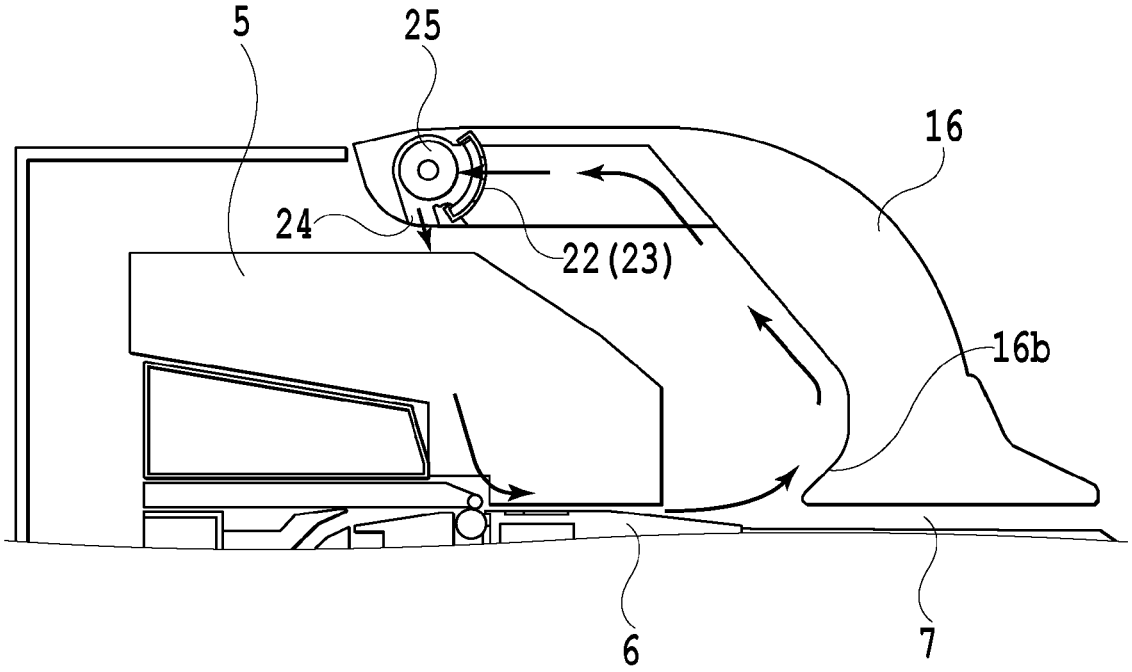
FIG. 10 is a concept diagram illustrating the airflow inside a variation of a printer.

FIG. 10 is a concept diagram illustrating the airflow inside the printer. In the embodiment described above, the distance from the location where air is blown (printing area) to the paper discharge port 7 that is downstream from the printing area is comparatively short, however, by causing the blower fan 25 to rotate in the opposite direction and reversing the direction of circulating airflow, the distance to the paper discharge port 7 can be made to be comparatively long.

In the printer, even when air is blown in the direction from upstream to downstream in the sheet conveyance direction, the blown air loses energy before reaching the paper discharge port 7, so it is difficult for ink mist to leak from the paper discharge port 7. In order to more completely prevent the leaking of ink mist, the air that is blown from upstream can be blown upward by providing an inclined surface such as inclined surface 16*b* at a location that forms the paper discharge port 7 in the access cover 16. In this way, depending on the construction of the printer, the direction of blown air can also be from upstream to downstream in the sheet conveyance direction, so in regard to this matter, the direction of the conveyance direction component of blown air is not limited.

As described above, by providing a blower unit that is exposed by opening the access cover, it is possible to achieve a printer having a blower unit for which maintenance can be performed more easily than was done conventionally.

(Second Embodiment)

In the following, a second embodiment of the present invention will be explained with reference to the drawings. The basic construction is the same as that of the first embodiment, so the explanation will mainly be centered on the characteristic construction.

Figure 11:
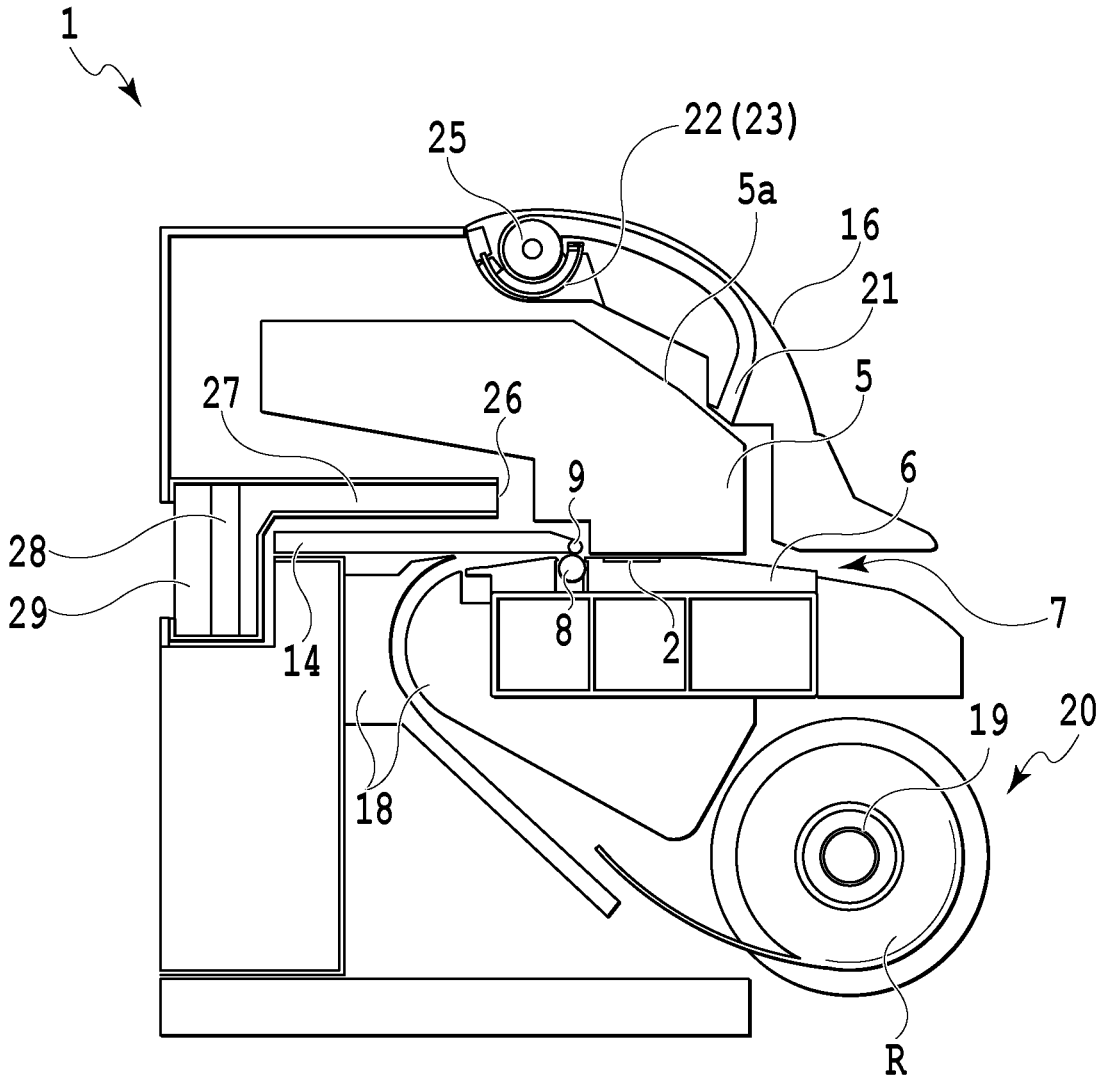
FIG. 11 is a cross-sectional view illustrating a printer.
Figure 12:
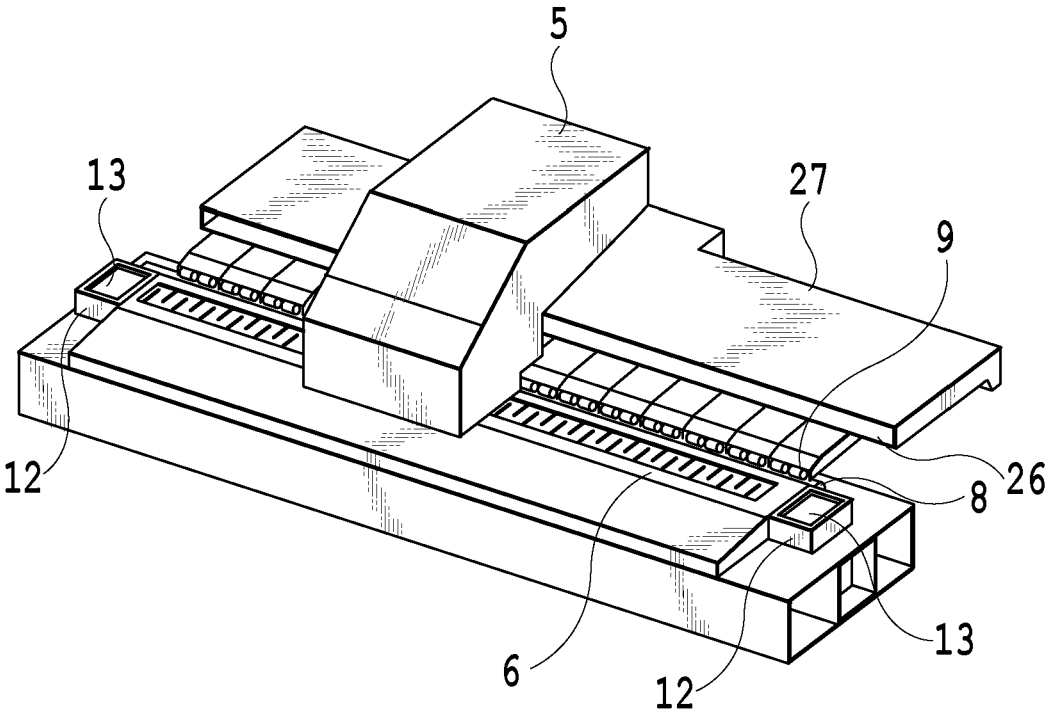
FIG. 12 is a perspective view illustrating the inside of a printer.

FIG. 11 is a cross-sectional view of a printer, and FIG. 12 is a perspective view of the inside of the printer. The printer comprises a platen 6, a carriage 5 that supports a printing head, and a blower fan 25 (part of a blower unit) that blows air onto a sheet R that is in the printing area by internal circulation. In this embodiment, suction is not performed by way of the platen 6, and there is no platen fan 10 as in the first embodiment. When a printing head is used that has an ejection port array of ejection ports having a short length, the area where ink drops are ejected at one time during printing is comparatively narrow, so it is comparatively easy to hold the sheet R approximately flat during printing without performing suction by the platen 6. Similarly, the construction of the preliminary ejection port 12 on the outside of the platen 6 is also different, and since there is no platen fan 10, there is an absorber 13 in the preliminary ejection port 12 that absorbs the ejected ink drops, and the ink drops that are ejected into the preliminary ejection port 12 are absorbed and collected by the absorber 13.

In the first embodiment described above, negative pressure is maintained inside the printer by sucking in part of the air that is circulating inside the printer by the platen fan 10 and discharging that air to the outside. However, in this embodiment, there is no platen fan. Instead of a platen fan, a discharge fan 29 for maintaining negative pressure inside the printer 1 and preventing ink mist from leaking is separately provided on the rear surface side of the printer, and is connected by an air intake duct 27 from the an air intake port 26 on the top of the pinch roller holder 14.

The air intake port 26 is located over nearly the entire area in the width direction of the platen 6 and intakes air, and discharges the air that was sucked in to the outside of the printer. When taking in air from the printing area, part of the vapor and ink mist is also collected together with the air, so a filter 28 for collecting the ink mist is provided before the discharge fan 29 so that ink mist is not leaked to the outside of the printer 1.

The vapor and ink mist that were not completely collected by the discharge fan 29 are carried by the upward airflow toward the air intake port 22 of the blower fan 25 located above, and collected by the filter 23 that is provided in the air intake port 22 of the blower fan 25. There are two air intake ports that cover nearly the entire printing area, so highly efficient collection of vapor and ink mist can be expected. In other words, an improvement in the drying efficiency and lengthening the life of the printer can be expected. In this way, even in the case of a printer having no platen fan, it is possible to obtain the same effect as in the first embodiment.

(Third Embodiment)

Figure 13:
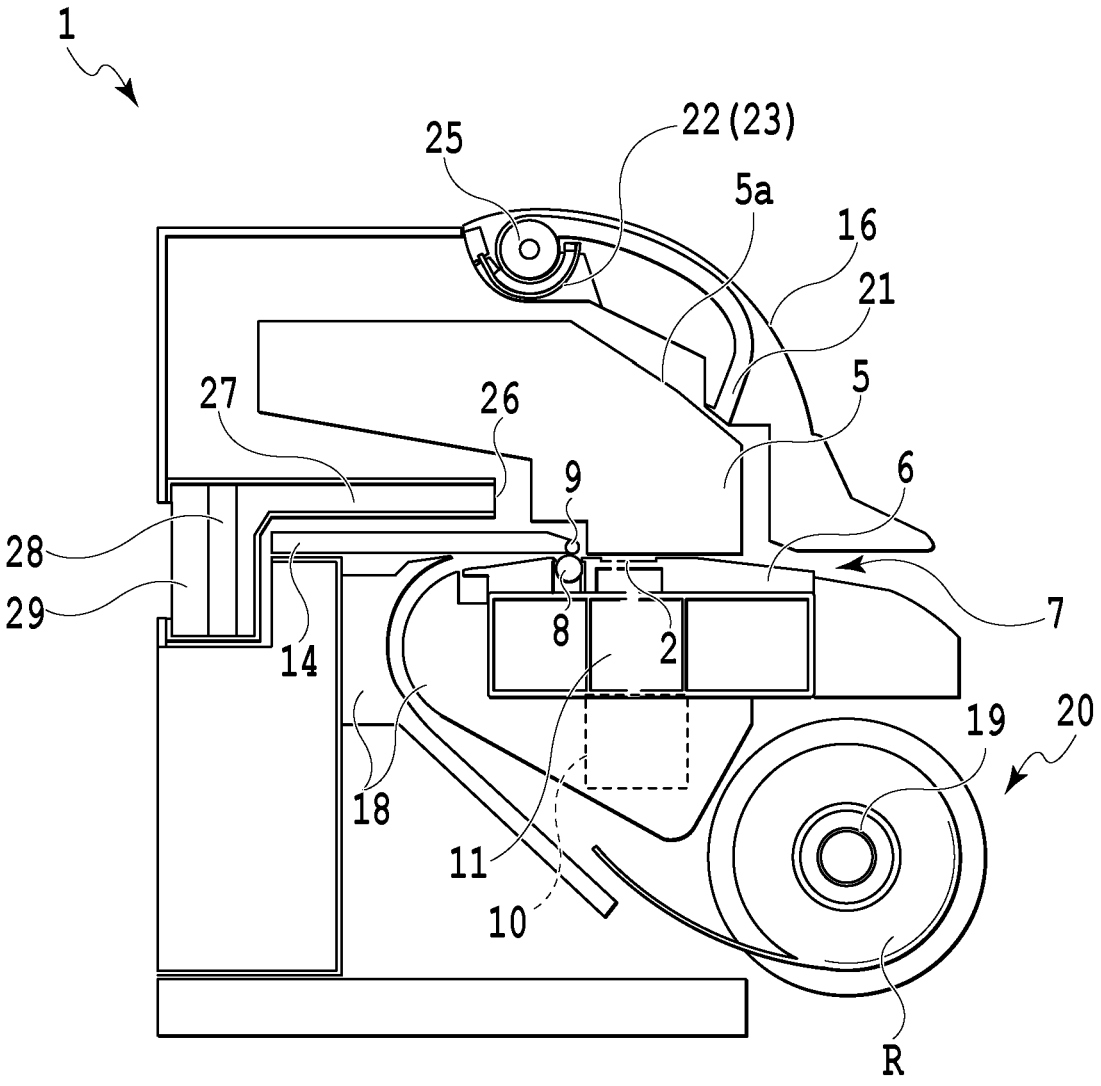
FIG. 13 is a cross-sectional view illustrating a printer.
Figure 14:
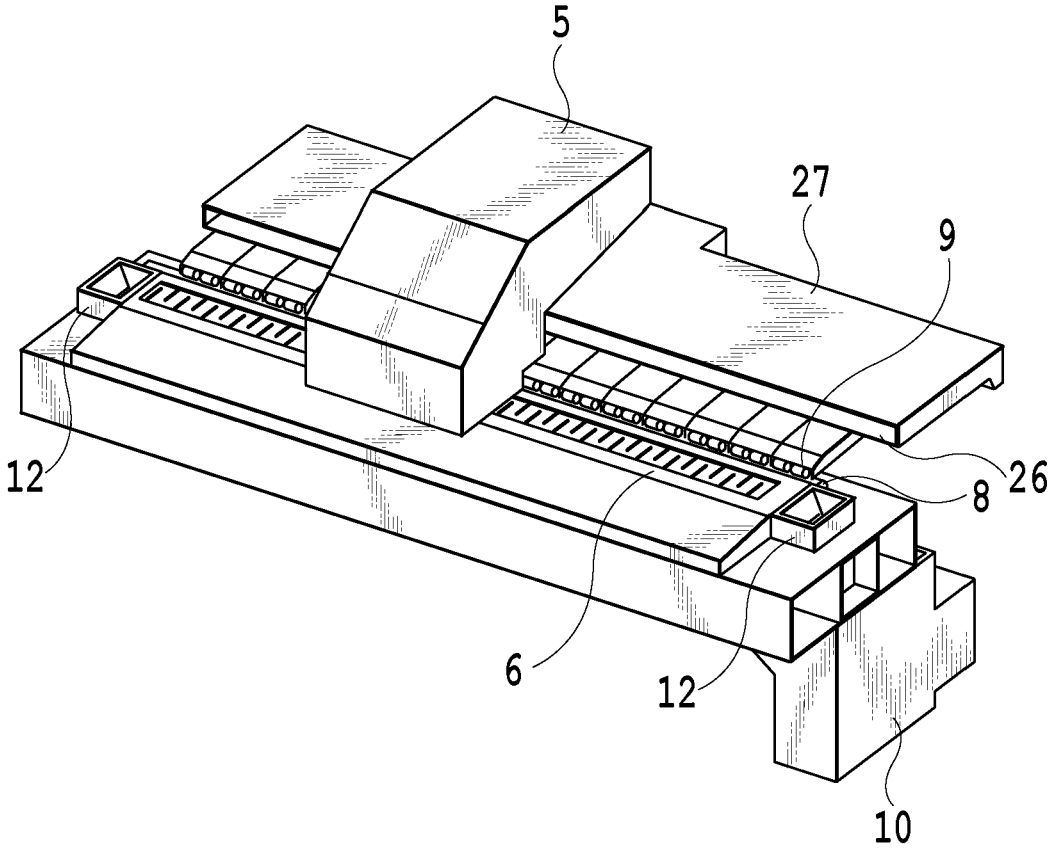
FIG. 14 is a perspective view illustrating the inside of a printer.

In the following, a third embodiment of the present invention will be explained with reference to the drawings. FIG. 13 is a cross-sectional view of a printer, and FIG. 14 is a perspective view of the inside of the printer. The printer comprises the same air intake port 26, air intake duct 27, filter 28 and discharge fan 29 as in the second embodiment described above. There is also a filter for collecting ink mist in each of the fans. Therefore, by using three fans, the blower fan 25, platen fan 10 and discharge fan 29, ink mist and vapor are collected, so it becomes even more difficult for vapor and ink mist to remain inside the printer.

In this way, even in a printer comprising three fans, a blower fan, platen fan and air intake fan, it is possible to obtain the same effect as in the first embodiment.

(Fourth Embodiment)

Figure 15:
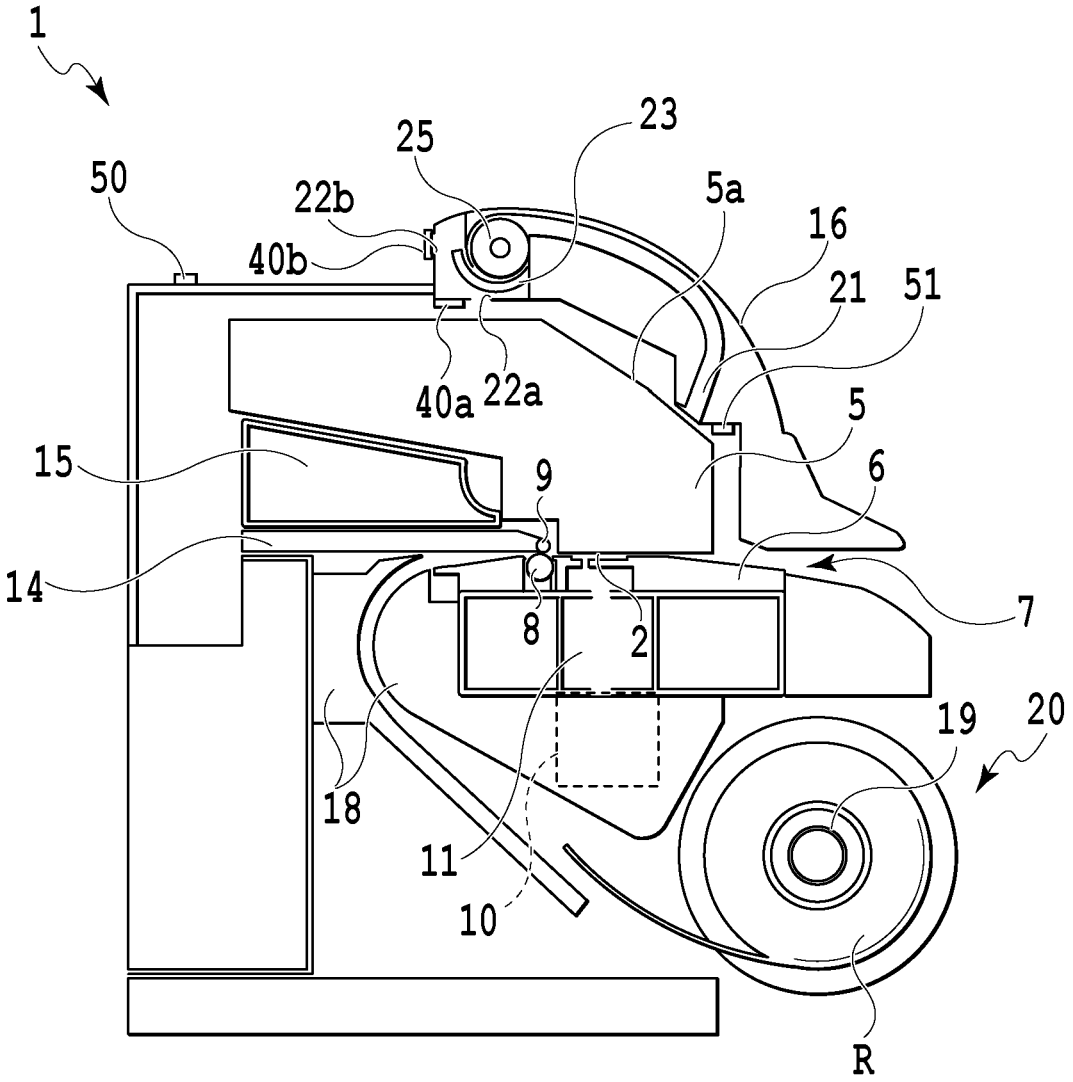
FIG. 15 is a cross-sectional view illustrating a printer.
Figure 16:
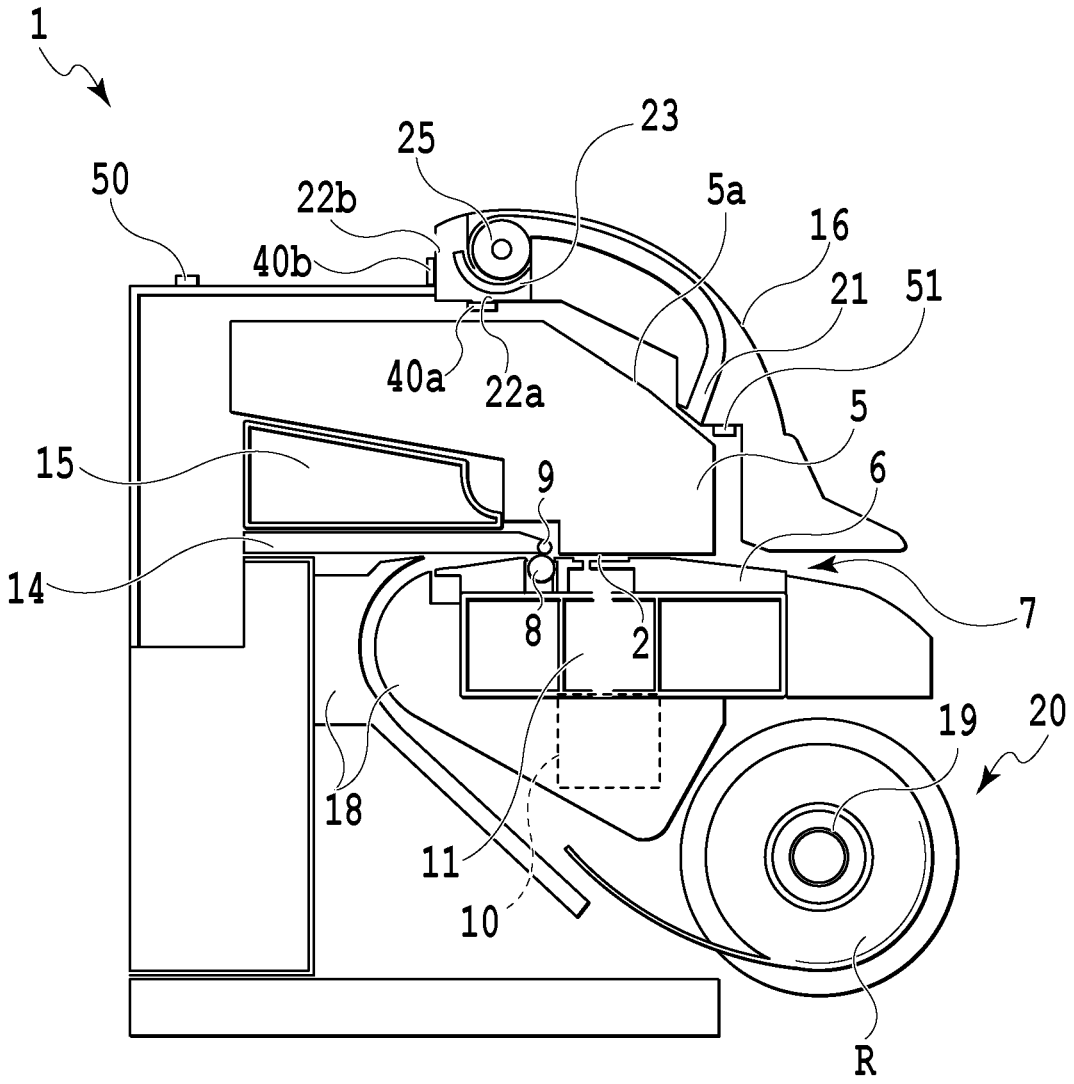
FIG. 16 is a cross-sectional view illustrating a printer.

In the following, a fourth embodiment of the present invention will be explained with reference to the drawings. FIG. 15 and FIG. 16 are cross-sectional views illustrating a printer. This embodiment is characterized by the blower fan 25 comprising an air intake port 22*a* that sucks in air that is inside the printer, and an air intake port 22*b* for taking in air from outside the printer. Furthermore, shutters 40*a*, 40*b* that are able to open and close the respective air intake ports 22*a*, 22*b* are provided in the air intake ports 22*a*, 22*b*. By opening and closing the shutters 40*a*, 40*b*, air that is blown by the blower fan 25 can be switched between air circulating inside the printer, and air that is taken in from the outside.

In construction that comprises a filter that collects ink mist and vapor, the humidity inside the printer increases by the moisture content of the filter becoming saturated, which brings about a decrease in drying efficiency. Therefore, by providing an air intake port 22*b* for taking in outside air from outside the printer, and by taking in outside air by switching from internally circulating blown air to blown air taken in from the outside by opening or closing the shutters when the humidity inside the printer becomes high, the high humidity inside the printer is lowered.

When shutter 40*a* is in the opened state as illustrated in FIG. 15, air that is turned upward by the structural member 15 is sucked in from the air intake port 22*a*. The blower fan 25 causes the air surrounding the printing area of the printer to internally circulate. The reason that the blower fan 25 blows air that circulates inside the printer is that it is presumed that ink mist will be generated during ink ejection.

However, as blowing air that circulates inside the printer is continued as is, the humidity inside the printer increases, and there is a possibility that the drying efficiency will decrease. Therefore, depending on the situation, the shutter 40*a* is closed and the shutter 40*b* is opened as illustrated in FIG. 16. By doing so, the air intake port 22*b* that connects to the outside is opened, and the inside of the printer is connected with the outside air. The blower fan 25 lowers the humidity inside the printer by stopping internal circulation and taking outside air having a relatively low humidity into the printer.

Figure 17:
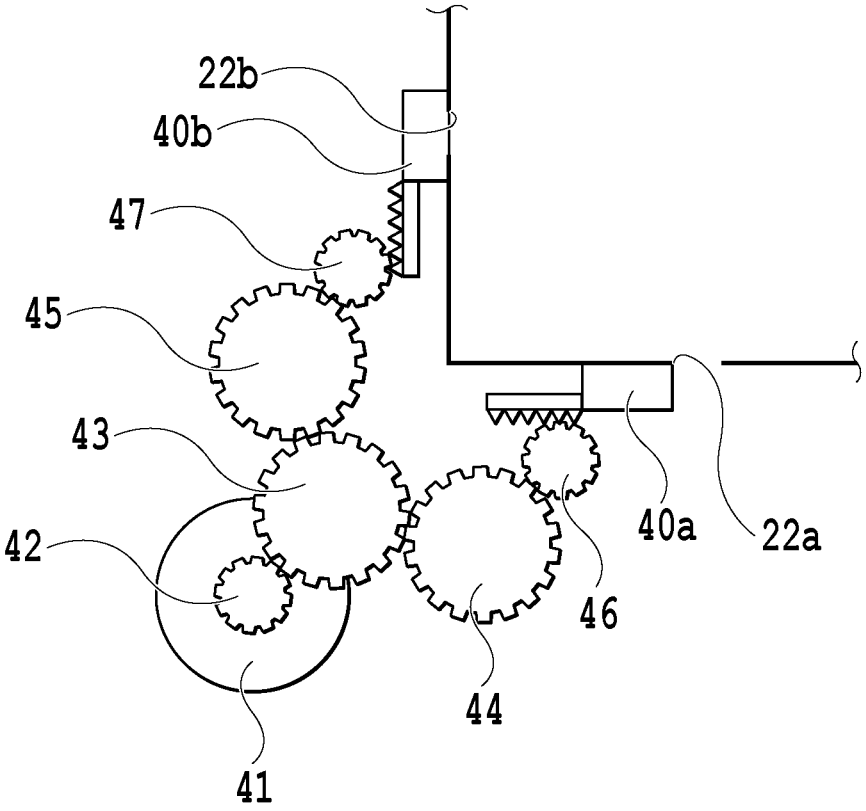
FIG. 17 is a view that illustrates the blower port and shutters of a printer.
Figure 18:
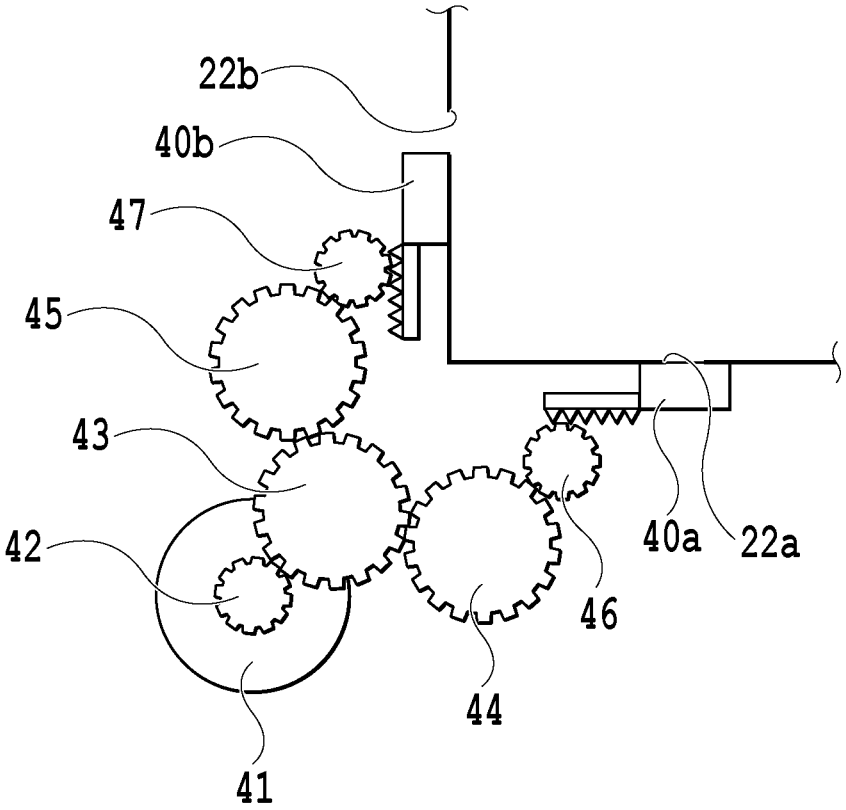
FIG. 18 is a view that illustrates the blower port and shutters of a printer.

FIG. 17 illustrates the state in which the shutter 40*a* of the air intake port 22*a* that is connected to the inside of the printer is open, and the shutter 40*b* of the air intake port 22*b* that connects to the outside of the printer is closed, and is a state in which it is possible to blow air that circulates inside the printer. FIG. 18 illustrates the state in which the shutter 40*a* on the inside of the printer is closed and the shutter 40*b* on the outside of the printer is open, and is a state in which it is possible to blow air that is taken in from the outside. When switching from the state in FIG. 17 in which it is possible to blow air that circulates inside the printer to the state in FIG. 18 in which it is possible to blow air that is taken in from the outside, a motor 41 is caused to rotate in the counterclockwise direction.

In doing so, that driving force is transmitted from a motor pulley 42 to gears 43, 44 and 46, and the shutter 40*a* is moved linearly to the closed state. Moreover, the driving force that rotates the motor 41 in the counterclockwise direction is transmitted from gear 43 to gears 45 and 47, and shutter 40*b* is moved linearly to the open state. Through these actions, the air intake port 22*a* is blocked, otherwise the air intake port 22*b* is opened, which results in moving to the state in which it is possible to blow air that is taken in from the outside.

When switching from the state in FIG. 18 in which it is possible to blow air that is taken in from the outside to the state in FIG. 17 in which it is possible to blow air that circulates inside the printer, the motor 41 is caused to rotate in the clockwise direction.

Figures 19, 19A:
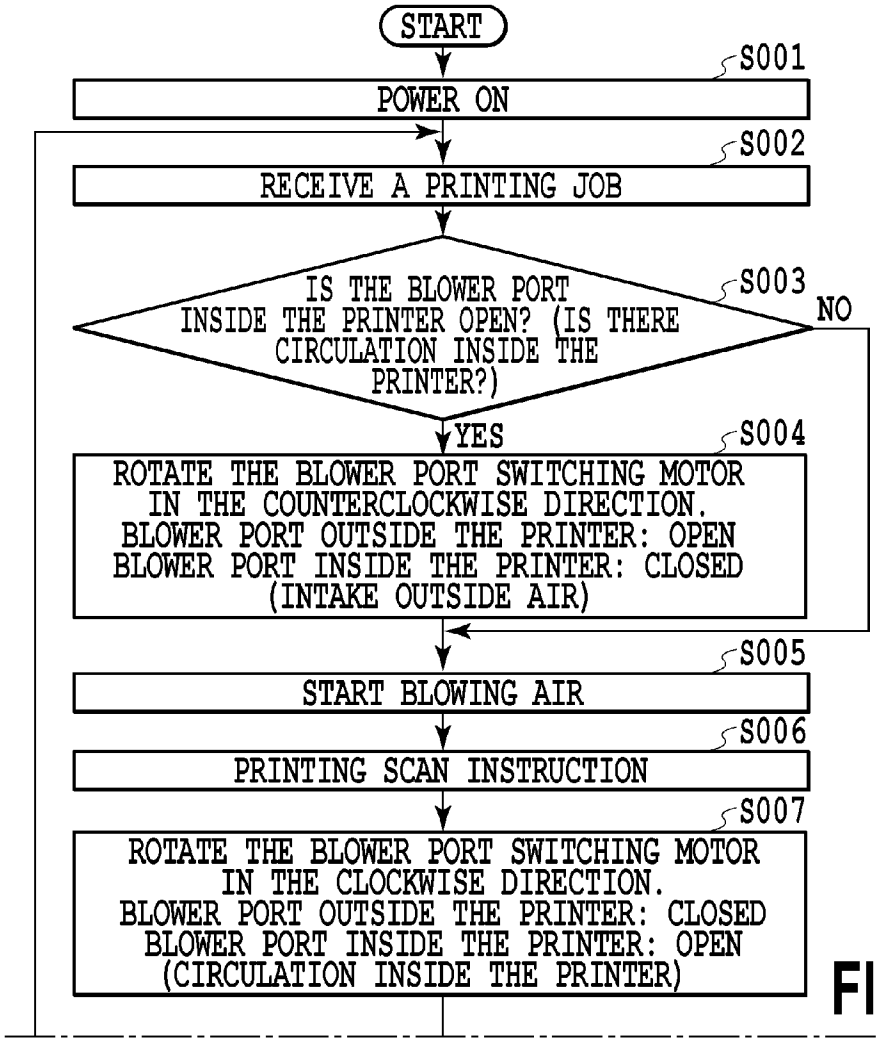
FIG. 19 is a diagram showing the relationship of FIGS. 19A and 19B.
FIG. 19A is a flowchart of the control operation of a printer.
Figure 19B:
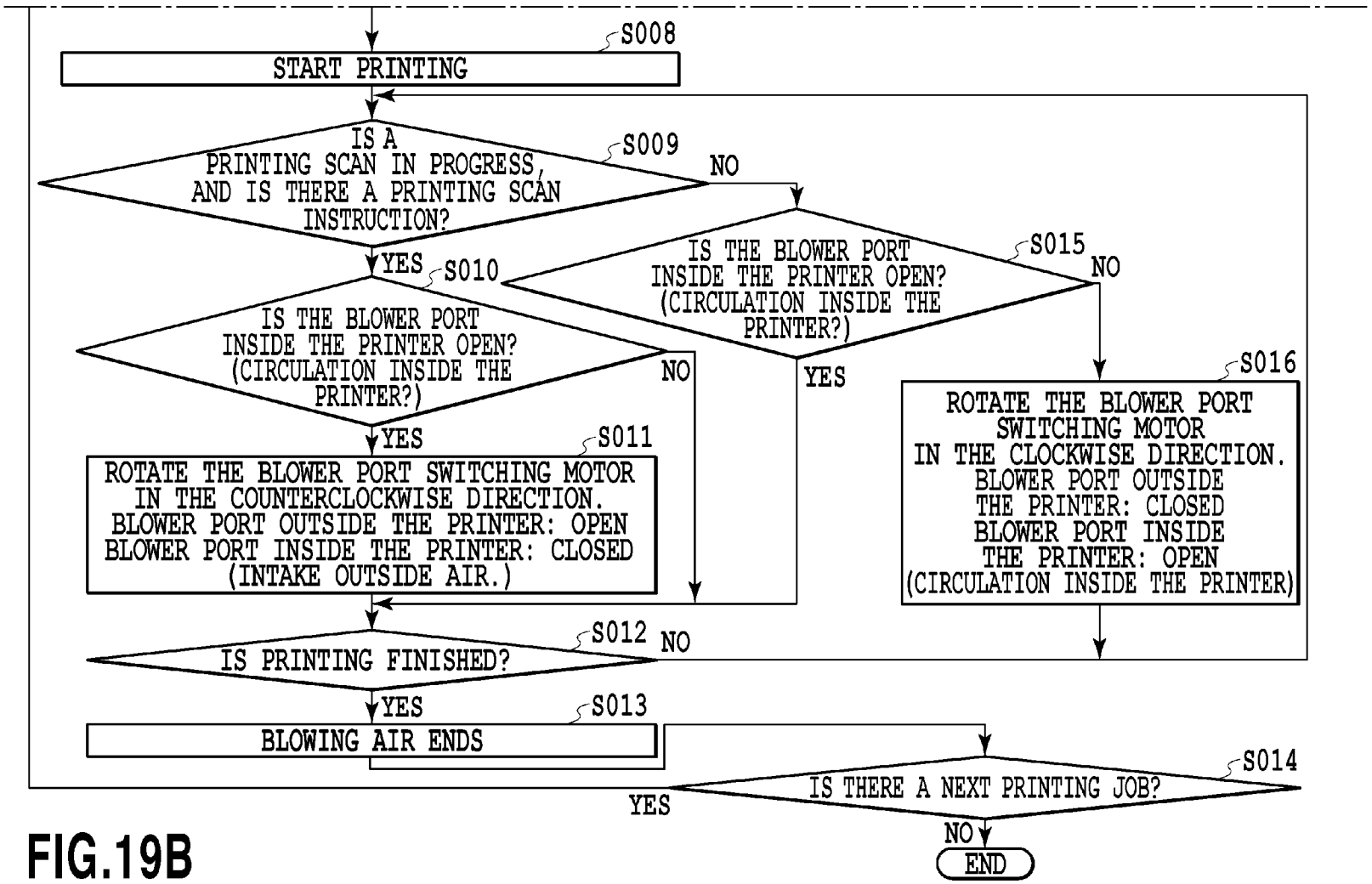
FIG. 19B is a flowchart of the control operation of a printer.

FIG. 19 is a flowchart of the control operation. In the following, the series of operations such as the timing for moving from the state in FIG. 15 of internal circulation inside the printer to the state in FIG. 16 of taking in air from the outside will be explained according to the flowchart.

When starting the printing process, after the power is turned ON in step S001, and a printing job is received in step S002, the printer 1 checks in step S003 whether the air intake port inside the printer is open. When the air intake port inside the printer is closed, in other words, when outside air is being taken in, processing moves to step S005 and air begins to be blown. In step S003, when the air intake port inside the printer is open, in other words, when air is circulating inside the printer, processing moves to step S004. In step S004, the air intake port switching motor 41 is caused to rotate in the counterclockwise direction, which sets the shutter 40*b* on the outside of the printer to the open state, and sets the shutter 40*a* on the inside of the printer to the closed state.

After that, air begins to be blown in step S005. After air begins to be blown, it becomes possible to blow air that is taken in from outside the printer, and outside air having relatively low humidity is taken in. As a result, the humidity inside the printer before printing is lowered, and the drying efficiency during printing is increased. When air is blown by taking in outside air, it becomes easy for positive pressure inside the printer to occur, however, since ink ejection is not being performed, ink mist is not generated, and it is possible to keep leakage of ink mist to the outside of the printer to a minimum.

After that, when a printing scan instruction is given in step S006, the air intake port switching motor 41 is caused to rotate in the clockwise direction in step S007. This rotation of the air intake port switching motor 41 sets the shutter 40*b* of the air intake port 22*b* that is connected to the outside of the printer to the closed state, and sets the shutter 40*a* of the air intake port 22*a* that is connected to the inside of the printer to the open state, and air begins to be blown that circulates inside the printer. In doing so, air is blown by internal circulation inside the printer while printing is being performed, and a state of blowing a large amount of air that suppresses leakage of ink mist to the outside of the printer as described above is achieved.

Printing begins in step S008, and in step S009, a check is performed as to whether or not a printing scan is in progress and whether or not a printing scan instruction has been given. When the result is "YES" in step S009, processing moves to step S010, and a check is performed as to whether or not there is internal air circulation inside the printer, in other words, whether the air intake port 22*a* that is connected to the inside of the printer is open. In step S010, when it is determined that the air intake port 22*a* that is connected to the inside of the printer is closed, in other words, outside air is being taken in, processing moves to step S012. When the result in step S009 is "NO", processing moves to step S015, and a check is performed as to whether or not there is internal air circulation inside the printer, or in other words, whether the air intake port 22*a* that is connected to the inside of the printer is open. In step S015, when it is determined that the air intake port 22*a* that is connected to the inside of the printer is open, in other words, when there is internal air circulation, processing moves to step S012.

In step S010, when the air intake port 22*a* that is connected to the inside of the printer is open, or in other words, when there is internal air circulation, processing moves to step S011, and the air intake port switching motor 41 is caused to rotate in the counterclockwise direction. As a result, the shutter 40*b* of the air intake port 22*b* that is connected to the outside of the printer is set to the open state, and the shutter 40*a* of the air intake port 22*a* that is connected to the inside of the printer is set to the closed state. In step S015, when the air intake port 22*a* that is connected to the inside of the printer is closed, or in other words, when outside air is being taken in, processing moves to step S016, and the air intake port switching motor 41 is caused to rotate in the clockwise direction. As a result, the shutter 40*b* of the air intake port 22*b* that is connected to the outside of the printer is set to the closed state, and the shutter 40*a* of the air intake port 22*a* that is connected to the inside of the printer is set to the open state, and air is blown by internal circulation inside the printer. After that, processing returns to step S009 and is repeated.

In step S012, even when printing is not finished, processing returns to step S009, and processing is repeated from step S009. In step S012, when printing is finished, processing moves to step S013 and blowing air ends, and in step S014, a check is performed as to whether there is a next printing job. When there is a printing job, processing returns to step S002, and processing is repeated from step S002. In step S014, when there is no next printing job, the printing process ends.

In this way, even in the case of a printer having construction that comprises an air intake port 22*a* that sucks in air inside the printer, and an air intake port 22*b* for taking in outside air from outside the printer, it is possible to obtain the same effect as in the first embodiment.

(Fifth Embodiment)

In the following, a fifth embodiment of the present invention will be explained with reference to the drawings. In this embodiment, blown air is switched between blowing air by taking in outside air, and blowing air by circulation inside the printer depending on the humidity inside and outside the printer. Therefore, there is a humidity sensor outside of the printer that detects the humidity outside of the printer, and a humidity sensor inside the printer that detects the humidity inside the printer.

Figure 20:
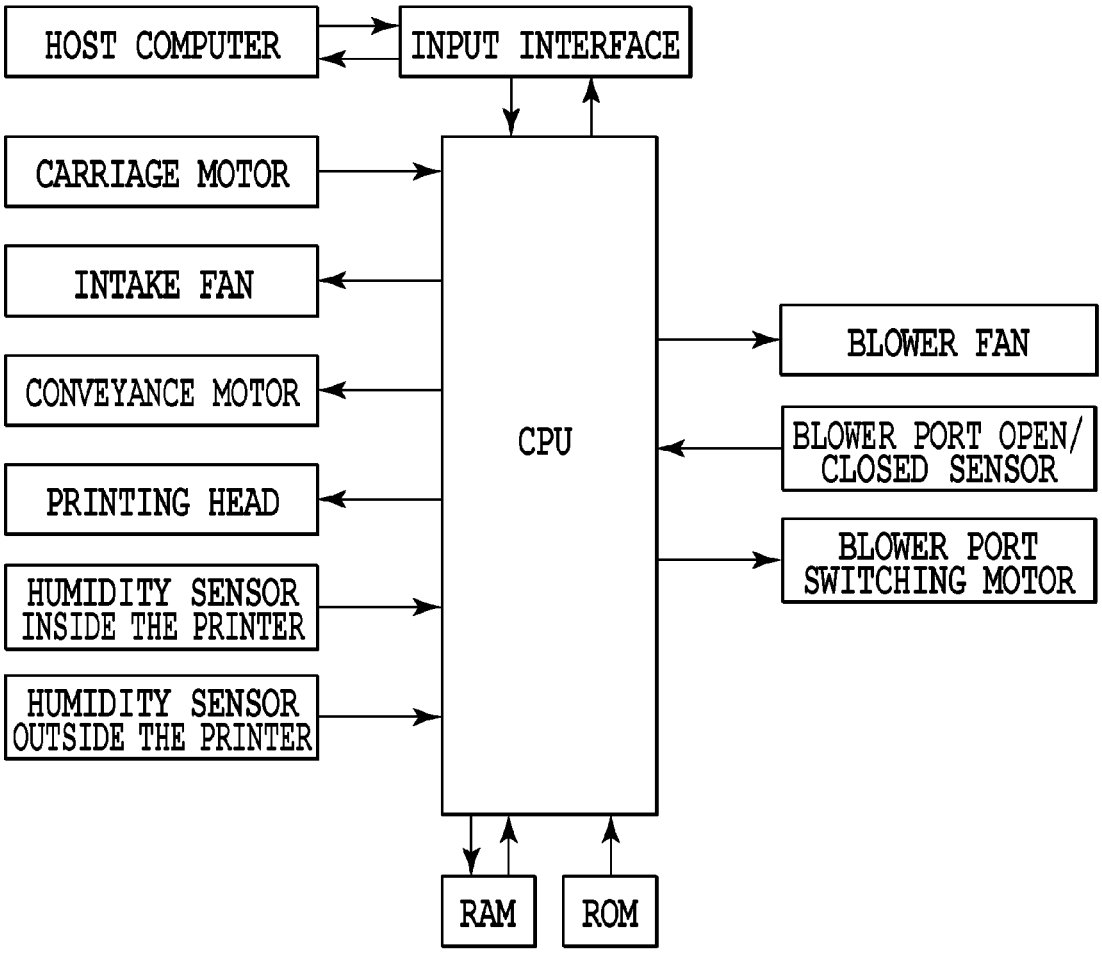
FIG. 20 is a block diagram that illustrates the configuration for controlling a printer.

FIG. 20 is a block diagram illustrating the configuration of the control system for the printer. When the printer comprises humidity sensors (hygrometers) outside and inside the printer, both the outside humidity sensor and inside humidity sensor are connected to the CPU. The CPU performs control of the printing head, conveyance motor, carriage motor, air intake fan, blower fan and blower port switching motor based on printing data and printing mode information from a host computer, humidity information from hygrometers inside and outside of the printer, and data from an air intake port open/closed sensor.

Figure 21A:
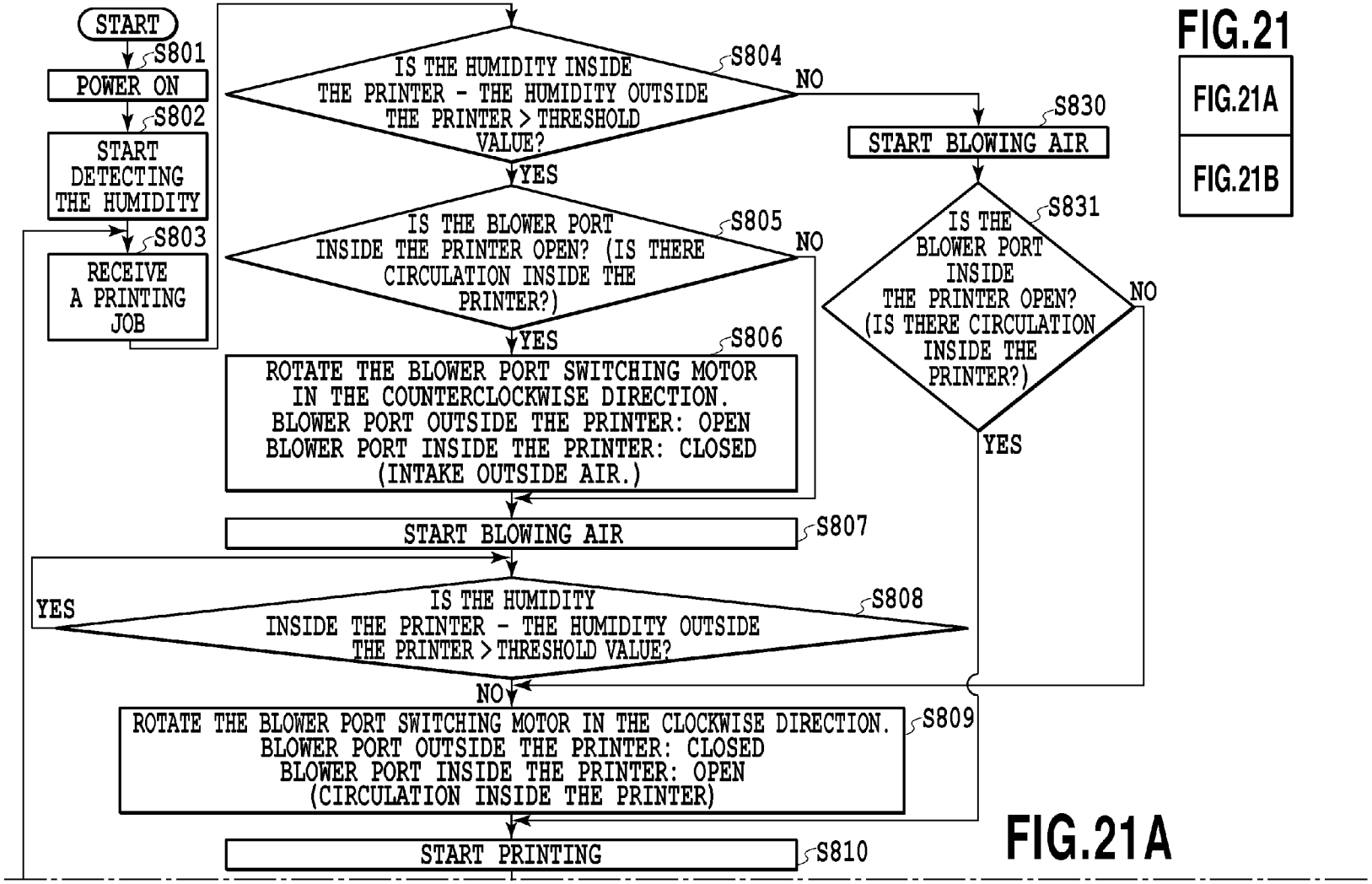
FIG. 21A is a flowchart of the control operation of a printer that comprises humidity sensors.
Figure 21B:
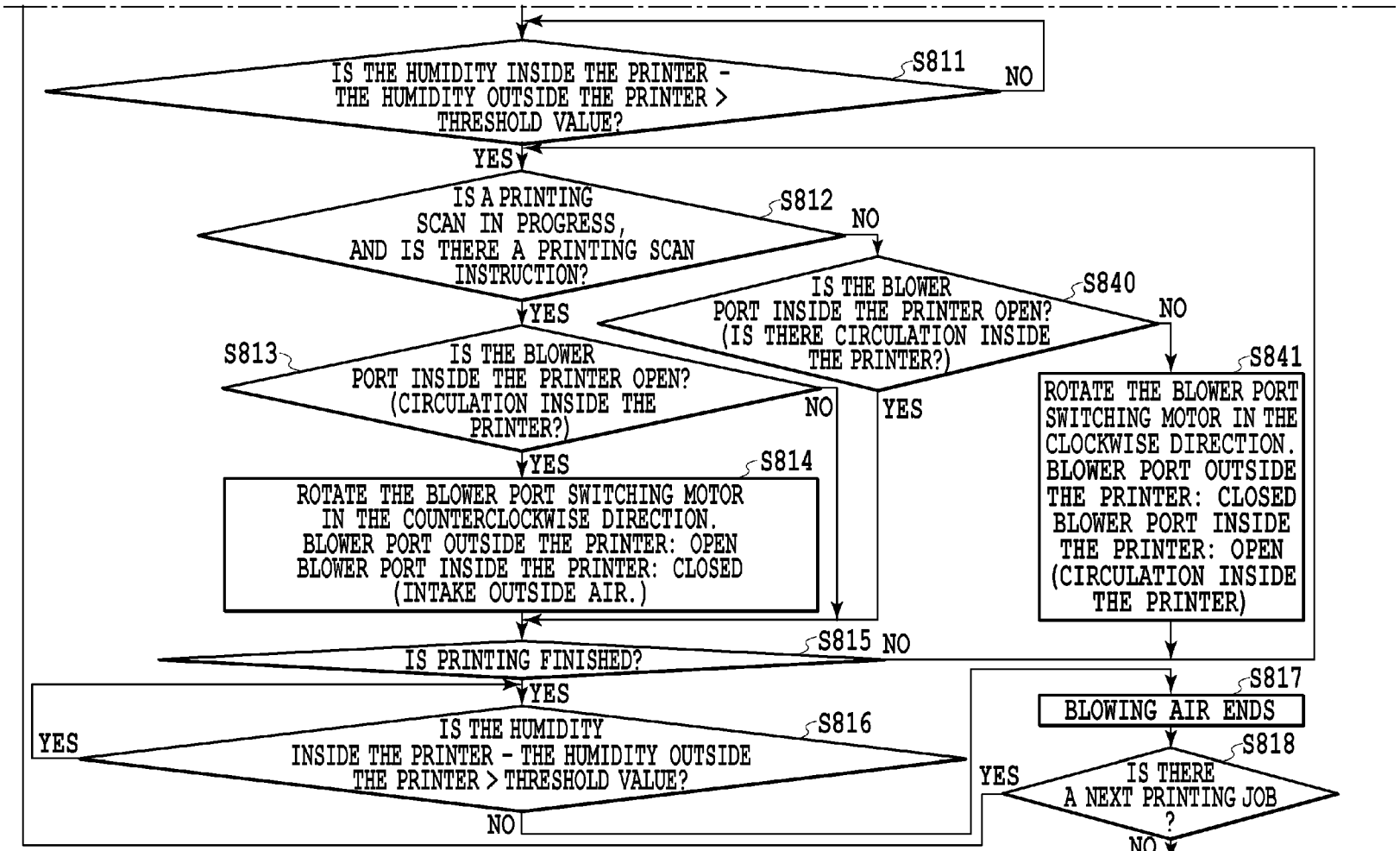
FIG. 21B is a flowchart of the control operation of a printer that comprises humidity sensors.

FIG. 21 is a flowchart of the control operation in a printer that comprises outside and inside humidity sensors. In the following, the printing operation will be explained according to the flowchart.

After the printing process is started and the power is turned ON in step S801, the printer 1 starts detecting the humidity inside and outside the printer in step S802. After that, when a printing job is received in step S803, the printer 1 performs a check in step S804 as to whether or not the value of the humidity inside the printer minus the humidity outside the printer is greater than a threshold value. When the humidity inside the printer minus the humidity outside the printer is not greater than the threshold value, processing moves to step S830, and when the humidity inside the printer minus the humidity outside the printer is greater than the threshold value, processing moves to step S805.

When processing moved from step S804 to step S830, blowing air by the blower fan 25 begins in step S830. An open/closed sensor (not illustrated in the figure) is provided in a shutter 40*a*, and makes it possible to detect the open/close state of an air intake port 22*a* that is connected to the inside of the printer. Instep S831, a check is performed as to whether or not the air intake port 22*a* that is connected to the inside of the printer is open. When the air intake port 22*a* inside the printer is closed, or in other words, when outside air is being taken in, processing moves to step S809. When the air intake port 22*a* inside the printer is open, or in other words, when air is circulating inside the printer, processing moves to step S810.

When processing moved from step S804 to step S805, a check is performed in step S805 as to whether or not the air intake port 22*a* inside the printer is open. In step S805, when the air intake port 22*a* inside the printer is closed, or in other words, when outside air is being taken in, processing moves to step S807, and when the air intake port 22*a* inside the printer is open, or in other words, when air is circulating inside the printer, processing moves to step S806. In step S806, an air intake port switching motor 41 is caused to rotate in the counterclockwise direction, and a shutter 40 of an air intake port 22*b* that is connected to the outside of the printer is set to the open state, and the shutter 40*a* of the air intake port 22*a* that is connected to the inside of the printer is set to the closed state.

Then, blowing air begins in step S807. After blowing of air begins, it becomes possible to blow air by taking in outside air, and air is blown by taking in outside air having a relatively low humidity, making it possible to improve the drying efficiency during printing by lowering the humidity inside the printer before printing. When air is blown by taking in outside air, it becomes easy for a positive pressure to occur inside the printer, however, since ink ejection is not being performed, ink mist is not generated, so it is possible to keep leakage to the inside of the printer to a minimum.

After blowing air has started in step S807, a check is performed again in step S808 as to whether or not the value of the humidity inside the printer minus the humidity outside the printer is greater than a threshold value. When the value of the humidity inside the printer minus the humidity outside the printer is not greater than a threshold value, processing moves to step S809, and when value of the humidity inside the printer minus the humidity outside the printer is greater than a threshold value, the check in step S808 is repeated. Outside air continues to be taken in until the value of the humidity inside the printer minus the humidity outside the printer is not greater than a threshold value, after which processing moves to step S809. In step S809, the air intake port switching motor 41 is caused to rotate in the clockwise direction, the shutter 40*b* outside the printer is set to the closed state, the shutter 40*a* of the air intake port 22*a* that is connected to the inside of the printer is set to the open state, and blowing air that circulates inside the printer begins.

As a result, air is blown so that air circulates inside the printer while printing is performed, and blowing a large amount of air that suppresses leaking of ink mist to the outside of the printer as described above is achieved. After that, printing begins in step S810, and a check is performed in step S811 as to whether or not the value of the humidity inside the printer minus the humidity outside the printer is greater than a threshold value. When the humidity inside the printer minus the humidity outside the printer is not greater than a threshold value, the check in step S811 is repeated. The check in step S811 is repeated until the humidity inside the printer minus the humidity outside the printer is greater than a threshold value, after which processing moves to step S812. In step S812 a check is performed as to whether or not a printing scan instruction has been given when a printing scan is not being performed.

When a printing scan is not being performed, and there is no printing scan instruction, processing moves to step S813, otherwise processing moves to step S840. In step S840, a check is performed as to whether or not the air intake port inside the printer is open, and when the air intake port inside the printer is closed, or in other words, when outside air is being taken in, processing moves to step S841, and when the air intake port inside the printer is open, or in other words, when air is circulating inside the printer, processing moves to step S815. In step S841, the air intake port switching motor 41 is caused to rotate in the clockwise direction, the shutter 40 of the air intake port 22*b* that is connected to the outside of the printer is set to the closed state, and the shutter 40*a* of the air intake port 22*a* that is connected to the inside of the printer is set to the open state. As a result, the state is set in which air is blown by taking in outside air, and it is possible to lower the humidity inside the printer. After that, processing moves to step S815.

Then, in step S815, a check is performed as to whether or not printing has ended, and when printing is continuing, processing moves to step S812, and this processing is repeated until printing has ended. Moreover, when printing has ended, after waiting until the humidity inside the printer minus the humidity outside the printer is greater than a threshold value in step S816, blowing of air ends in step S817, and in step S818 a check is performed as to whether there is a next printing job. When there is a printing job, processing returns to step S803, and processing is repeated from step S803. When there is no next printing job in step S818, the printing process ends.

In this way, even in the case of a printer that comprises humidity sensors (hygrometers) on the inside and outside of the printer, and that opens or closes shutters depending on the detection results of the humidity sensors, it is possible to obtain the same effect as in the first embodiment.

(Sixth Embodiment)

Figure 22:
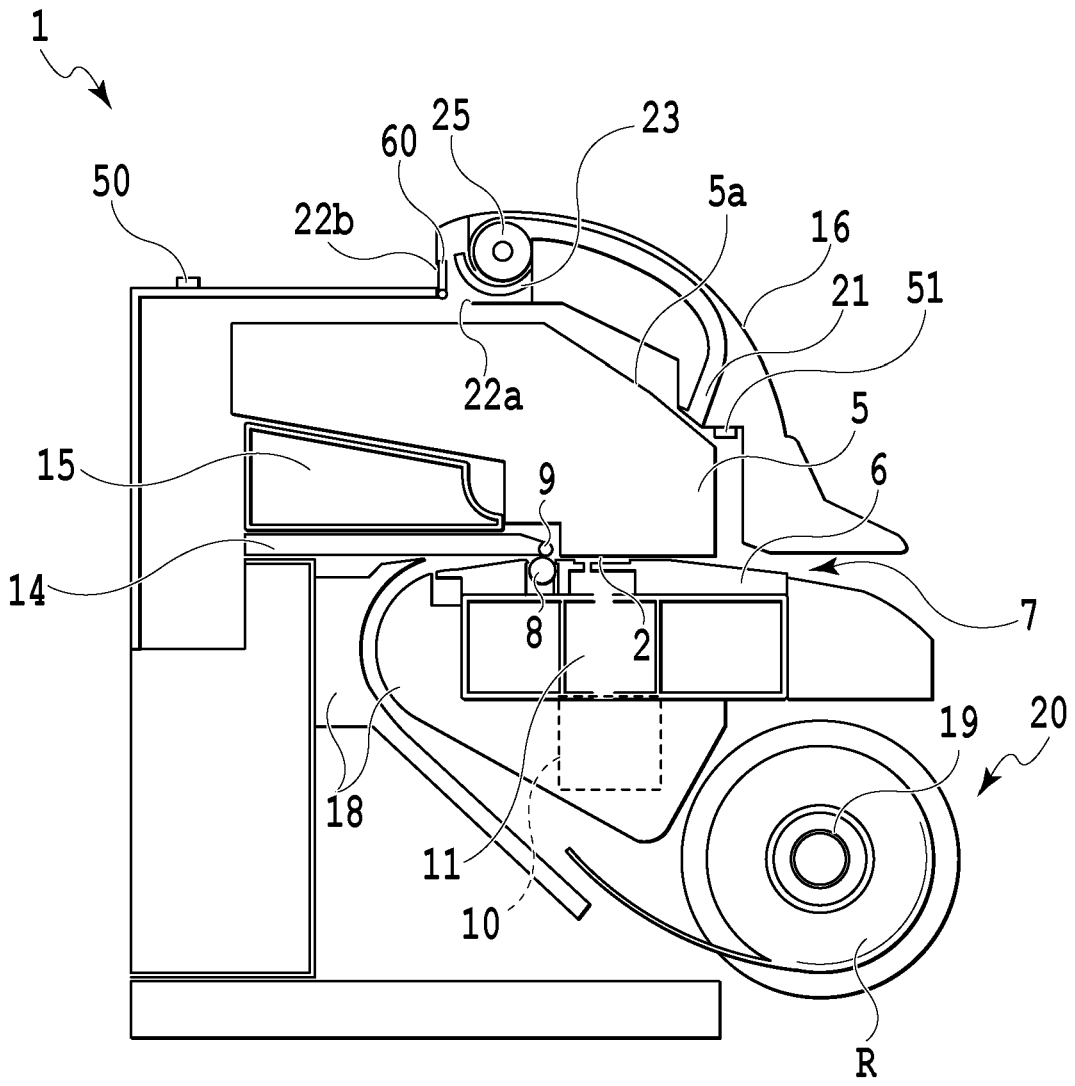
FIG. 22 is a cross-sectional view that illustrates the construction of a printer.
Figure 23:
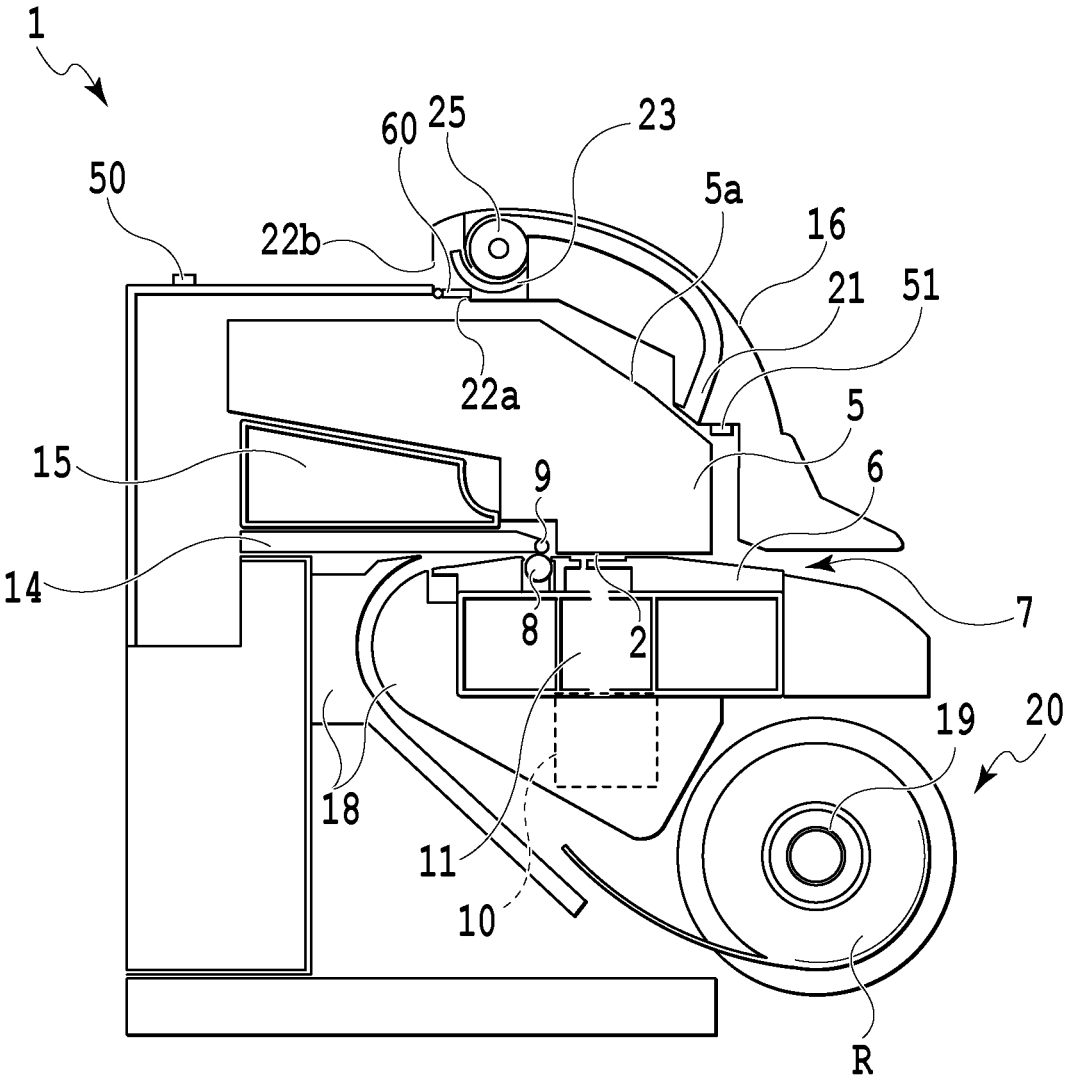
FIG. 23 is a cross-sectional view that illustrates the construction of a printer.

In the following, a sixth embodiment of the present invention will be explained with reference to the drawings. FIG. 22 and FIG. 23 are cross-sectional views illustrating the schematic construction of a printer. There is a switching door 60 for switching between air intake ports 22*a* and 22*b* with respect to a blower fan 25. The switching door 60 is connected to a drive motor, and by performing an operation for opening or closing the switching door 60 by driving the motor, it is possible to switch between opening and closing the air intake ports 22*a*, 22*b*. When blowing air that circulates inside the printer, the air intake port 22*b* is closed by the switching door 60 as illustrated in FIG. 22, and air inside the printer is sucked in from the air intake port 22*a;* and when blowing air by taking in outside air, the air intake port 22*a* is closed by the switching door 60 as illustrated in FIG. 23, and outside air is taken in from the air intake port 22*b*. In this way, switching between blowing air that circulates inside the printer and air that is taken in from the outside is performed by the switching door 60. The other basic functions and construction are the same as in the first embodiment. Operating the switching door 60 is not limited to a motor, and can also be driven by another actuator such as an air cylinder.

In this way, by using a switching door to control switching the blowing of air by a blower fan between circulating inside the printer and taking in air from the outside, it is possible to obtain the same effect as in the first embodiment.

(Seventh Embodiment)

Figure 24:
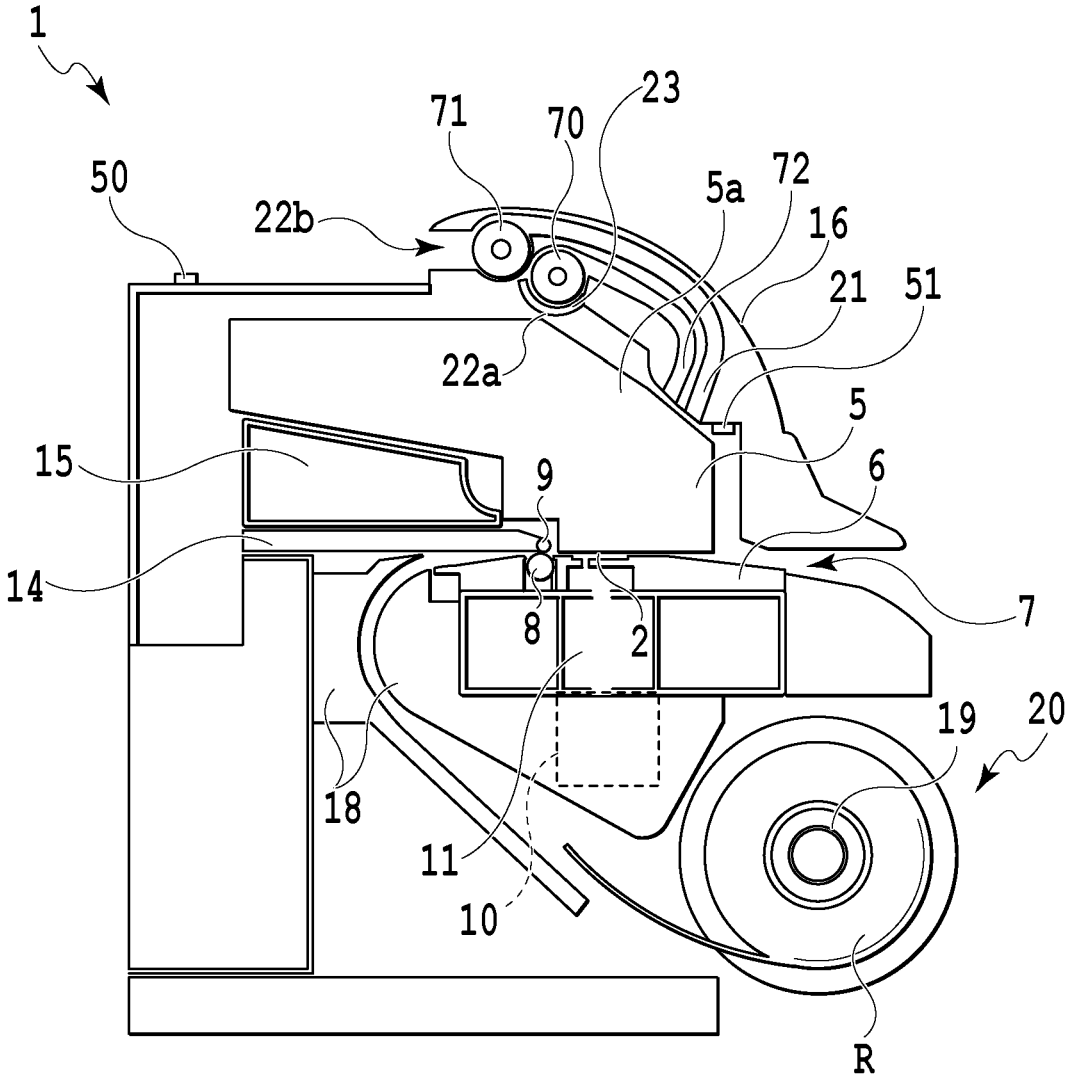
FIG. 24 is a cross-sectional view that illustrates the construction of a printer.

In the following, a seventh embodiment of the present invention will be explained with reference to the drawings. FIG. 24 is a cross-sectional view illustrating the schematic construction of a printer. The printer 1 comprises two blower fans 70, 71, and the flow paths for the flow of air generated by each of the fans are separated. In the flow path of blower fan 70 there is an air intake port 22*a* and a blower port 72, and in the flow path of blower fan 71 there is an air intake port 22*b* and a blower port 21. When blowing air that circulates inside the printer, the blower fan 71 is stopped, and only blower fan 70 is used to blow air by taking in air from inside the printer. Moreover, when blowing air by taking in outside air, the blower fan 70 is stopped, and only blower fan 71 is used to take in outside air.

In this way, blowing air is switched between circulation inside the printer and taking in outside air. The other basic functions and construction are the same as in the first embodiment.

By controlling the flow of intake air by using plural air intake fans in this way, it is possible to obtain the same effect as in the first embodiment.

In the first to seventh embodiments explained up to this point, so-called serial type printing having construction in which a carriage 5 mounted with a printing head is able to move back-and-forth in the width direction (main scanning direction) of a sheet R was described. However, the invention is not limited to serial type printing, and the invention can also be applied to so-called line type printing in which the printing head is located over the entire printing area and is not moved back-and-forth by a carriage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-094750 filed May 1, 2014, which is hereby incorporated by reference wherein in its entirety.

What is claimed is:

1. An inkjet printing apparatus comprising:

an access cover capable of being opened to allow maintenance of the apparatus; and a blower unit including a fan, a duct provided along a surface of the access cover, a blower port provided at an end of the duct, and an air intake port that takes air from outside into the apparatus, the air intake port being capable of opening to take air from outside and closing to cause circulated airflow inside the apparatus, wherein when the access cover is in a closed state, the blower unit blows airflow from the blower port though the duct on a sheet where ink has been applied, and the blower unit causes an air circulation inside the apparatus, and when the access cover is in an opened state, the blower port is open together with the access cover to be exposed.

2. The printing apparatus according to claim 1, wherein when the access cover is open, the fan and the blower port are exposed.

3. The printing apparatus according to claim 2, wherein the blower unit includes a replaceable filter, and when the access cover is open, the filter is exposed.

4. The printing apparatus according to claim 3, wherein the airflow blown from the blower port is collected through the filter toward the fan in order to cause the air circulation inside the apparatus.

5. The printing apparatus according to claim 1, further comprising a discharge fan that discharges air out of the apparatus thereby generating negative pressure inside the apparatus.

6. The printing apparatus according to claim 5, wherein the discharge fan is provided in a platen unit that supports the sheet by suction.

7. An inkjet printing apparatus comprising:

an access cover capable of being opened to allow maintenance of the apparatus; and a blower unit comprising an air intake port that takes air from outside into the apparatus, and a device for opening and closing the air intake port, to switch between blowing circulated air inside the apparatus and blowing air that is taken in from the outside, wherein when the access cover is in a closed state, the blower unit blows airflow on a sheet where ink has been applied, and when the access cover is in an opened state, the intake port is open together with the access cover to be exposed.

8. The printing apparatus according to claim 7, wherein blowing air is switched between blowing air circulating inside the apparatus and blowing air that is taken in from the outside based on the humidity.

9. An inkjet printing apparatus comprising:

an access cover capable of being opened to allow maintenance of the apparatus;

a blower unit having a blower fan, a duct provided along a surface of the access cover, a blower port provided at an end of the duct, and an air intake port that takes air from outside into the apparatus, wherein airflow that is blown from the blower port hits a sheet where ink has been applied and then again enters the blower fan thereby circulating air inside the apparatus, and the air intake port being capable of opening to take air from outside and closing to cause circulated air flow inside the apparatus; and a discharge fan configured to discharge air out of the apparatus in order to generate negative pressure inside the apparatus, wherein in a case where the access cover is in an opened state, the blower port is open together with the access cover to be exposed.

10. The printing apparatus according to claim 9, wherein the discharge fan is provided in a platen unit that supports the sheet by suction.

* * * * *